US007568693B2

(12) United States Patent
Izuchi et al.

(10) Patent No.: US 7,568,693 B2
(45) Date of Patent: Aug. 4, 2009

(54) IMAGE FORMING APPARATUS HAVING SUPPORTING MEMBER THAT SUPPORTS BOTTOM PORTION OF FEEDING TRAY

(75) Inventors: Masatoshi Izuchi, Ichinomiya (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 50 days.

(21) Appl. No.: 11/670,216

(22) Filed: Feb. 1, 2007

(65) Prior Publication Data

US 2007/0176351 A1 Aug. 2, 2007

(30) Foreign Application Priority Data

Feb. 2, 2006 (JP) ..... 2006-025843

(51) Int. Cl.
*B65H 1/00* (2006.01)

(52) U.S. Cl. ..... 271/145; 271/117; 271/118

(58) Field of Classification Search ..... 271/117, 271/118, 145

See application file for complete search history.

(56) References Cited

U.S. PATENT DOCUMENTS

| | | | | |
|---|---|---|---|---|
| 4,279,504 | A * | 7/1981 | Brown et al. | 355/72 |
| 6,244,588 | B1 | 6/2001 | Tsubakimoto et al. | |
| 6,382,619 | B1 * | 5/2002 | Gustafson et al. | 271/117 |
| 6,382,620 | B1 * | 5/2002 | Gaarder et al. | 271/117 |
| 6,793,215 | B2 * | 9/2004 | Salomon | 271/171 |
| 6,974,127 | B2 * | 12/2005 | Kang | 271/10.11 |
| 7,258,335 | B2 * | 8/2007 | Johnson et al. | 271/10.01 |
| 7,275,741 | B2 * | 10/2007 | Worley et al. | 271/117 |
| 7,296,790 | B2 * | 11/2007 | Kim | 271/114 |
| 7,303,189 | B2 * | 12/2007 | Huang et al. | 271/118 |
| 2002/0084574 | A1 * | 7/2002 | Kim | 271/118 |
| 2003/0075856 | A1 * | 4/2003 | Park | 271/117 |

(Continued)

FOREIGN PATENT DOCUMENTS

JP 2000-177855 A 6/2000

(Continued)

OTHER PUBLICATIONS

Japanese Patent Office, Office Action for Patent Application No. JP2006-025843, mailed Dec. 16, 2008. (Counterpart of above-captioned U.S. Patent Application.).

*Primary Examiner*—Patrick H Mackey
*Assistant Examiner*—Prasad V Gokhale
(74) *Attorney, Agent, or Firm*—Baker Botts L.L.P.

(57) ABSTRACT

A feeding tray is detachably mounted on a base member and includes a bottom portion. The bottom portion has a first side that is configured to hold a recording sheet and a second side opposite the first side. An image forming unit forms an image on the recording sheet. A feeding roller is configured to rotatingly contact the recording sheet held in the feeding tray, thereby feeding the recording sheet toward the image forming unit in a conveying direction. A roller arm has one end that rotatably supports the feeding roller and another end opposite the one end. The roller arm is configured to swing about the another end, thereby generating a pressing force for pressing the feeding roller against the recording sheet. A supporting member is provided at the second side of the bottom portion and is configured to support the bottom portion against the pressing force.

8 Claims, 22 Drawing Sheets

U.S. PATENT DOCUMENTS

2004/0207145 A1* 10/2004 Chang ..... 271/117
2005/0023745 A1* 2/2005 Morimoto et al. ..... 271/117
2005/0073087 A1* 4/2005 Kadowaki et al. ..... 271/118
2005/0196212 A1 9/2005 Takemoto et al.
2006/0071399 A1* 4/2006 Asada et al. ..... 271/117
2007/0290430 A1* 12/2007 Lee ..... 271/117

FOREIGN PATENT DOCUMENTS

JP 2001-080759 A 3/2001
JP 2002-249241 A 9/2002
JP 2005-247542 A 9/2005

* cited by examiner

IMAGE FORMING APPARATUS HAVING SUPPORTING MEMBER THAT SUPPORTS BOTTOM PORTION OF FEEDING TRAY

CROSS REFERENCE TO RELATED APPLICATIONS

This application claims priority from Japanese Patent Application No. 2006-025843 filed Feb. 2, 2006. The entire content of the priority application is incorporated herein by reference.

TECHNICAL FIELD

The invention relates to an image forming apparatus, and more particularly to an inkjet recording apparatus for forming an image by ejecting ink droplets on a recording sheet,

BACKGROUND

As described in Japanese Patent Application Publication No. 2005-247542, in image forming apparatuses such as an inkjet recording apparatus, images are formed on recording sheets normally by feeding (conveying) recording sheets placed in a sheet feeding tray one sheet at a time by means of a sheet feeding roller such as a pickup roller to an image forming section.

Since the sheet feeding roller needs to apply conveying force to the recording sheet as the sheet feeding roller rotatingly contacts the recording sheet, the sheet feeding roller is pressed against the recording sheet so as to generate required frictional force at the contact area of the sheet feeding roller and the recording sheet when the recording sheet is fed (conveyed).

SUMMARY

On the other hand, as the conveying resistance (resistance against conveyance) of the recording sheet that generates on the conveying path from the sheet feeding tray to the image forming section increases, the conveying force applied to the recording sheet by the sheet feeding roller needs to be increased. Then, the frictional force generated at the contact area of the sheet feeding roller and the recording sheet needs to be increased by raising the pressure applied to the recording sheet by the sheet feeding roller in order to increase the applied conveying force.

Therefore, when feeding (conveying) a recording sheet that has a large coefficient of friction such as a sheet of glossy paper and a recording sheet that causes a large conveying resistance such as a thick sheet, the sheet feeding roller needs to be pressed against the recording sheet under high pressure.

However, when the bottom of the sheet feeding tray has only a small flexural rigidity (rigidity against deflection), the bottom of the sheet feeding tray can easily be deflected and the recording sheet is moved (displaced) in the direction of the applied pressure when the sheet feeding roller is pressed against the recording sheet under high pressure. Then, there arises a problem that it is not possible to produce a large frictional force and to apply a sufficient conveying force to the recording sheet.

Additionally, the sheet feeding roller is rotatably attached to the distal end of the roller arm that is swingably provided at the main body of the image forming apparatus. Therefore, as the bottom of the sheet feeding tray is deflected in the direction of the applied pressure and the recording sheet is also deflected in that direction, an angle formed by the roller arm and the recording sheet (to be referred to as arm angle hereinafter) is increased.

As the arm angle is increased, the sheet feeding roller moves toward the upstream side of the conveying path, depresses the recording sheet, and cannot apply a conveying force to the recording sheet. Then, there arises a problem that the recording sheet placed in the sheet feeding tray can no longer be fed (conveyed).

While the above-identified problem may be dissolved by increasing the thickness of the bottom of the sheet feeding tray or taking some other measure for raising the flexural rigidity of the bottom of the sheet feeding tray, a large thickness of the bottom of the sheet feeding tray increases the size of the sheet feeding tray and hence the entire image forming apparatus.

In view of the foregoing, it is an object of the invention to provide an image forming apparatus that can stably feed a recording sheet that has a large conveying resistance without increasing the size of the sheet feeding tray.

In order to attain the above and other objects, the invention provides an image forming apparatus. The image forming apparatus includes a base member, a feeding tray, an image forming unit, a feeding roller, a roller arm, and a supporting member. The feeding tray is detachably mounted on the base member and includes a bottom portion. The bottom portion has a first side that is configured to hold a recording sheet and a second side that is opposite to the first side. The image forming unit forms an image on the recording sheet. The feeding roller is configured to rotatingly contact the recording sheet held in the feeding tray, thereby feeding the recording sheet toward the image forming unit in a conveying direction. The roller arm has one end that rotatably supports the feeding roller and another end that is opposite to the one end. The roller arm is configured to swing about the another end, thereby generating a pressing force for pressing the feeding roller against the recording sheet. The supporting member is provided at the second side of the bottom portion and is configured to support the bottom portion against the pressing force.

DETAILED DESCRIPTION

First Embodiment

An image forming apparatus according to a first embodiment of the invention will be described with reference to FIGS. 1 through 20C. In the following description, the expressions "front", "rear", "upper", "lower", "right", and "left" are used to define the various parts when the image forming apparatus is disposed in an orientation in which it is intended to be used.

The image forming apparatus according to the first embodiment is a so-called multifunction apparatus having a plurality of functions including a printer function, a scanner function, a color copier function, and a facsimile function.

1. Outline of Image Forming Apparatus 1

Figure 1:
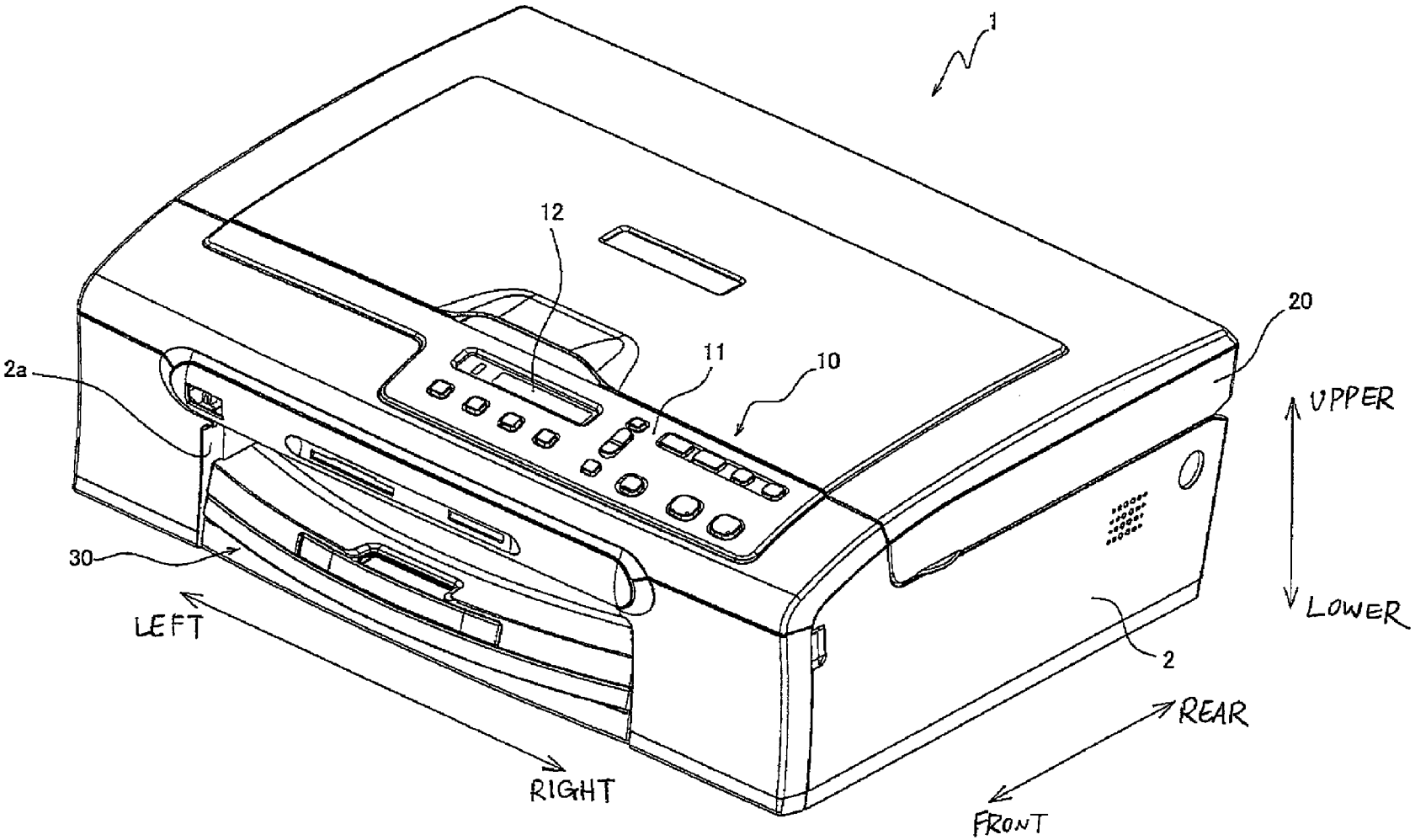
FIG. 1 is a perspective view of an image forming apparatus according to a first embodiment of the invention.

An image forming apparatus 1 includes a main body casing 2 that defines the appearance of the apparatus 1. As shown in FIG. 1, the main body casing 2 is a substantially rectangularly parallelepipedic box-shaped member that is made of a resin material. In the image forming apparatus 1 of the present embodiment, the near side in FIG. 1 is the front side and the upper side in FIG. 1 is the upper side in the gravitational direction.

An operation section 11 and an operation panel 10 are provided in a front area of the top surface of the main body casing 2. Various operation buttons for input operations are arranged on the operation section 11. The operation panel 10 includes a display section 12 for displaying various pieces of information including messages to the user and images.

A scanner unit 20 for reading an image on an original is arranged at a rear side of the operation panel 10 in an upper part of the main body casing 2. The scanner unit 20 operates as image reading means when the scanner function, the color copier function or the facsimile function of the apparatus is selected. Since the scanner unit 20 includes an imaging means such as a CCD and has a known configuration, the scanner unit 20 will not be described in greater detail here.

Figure 2:
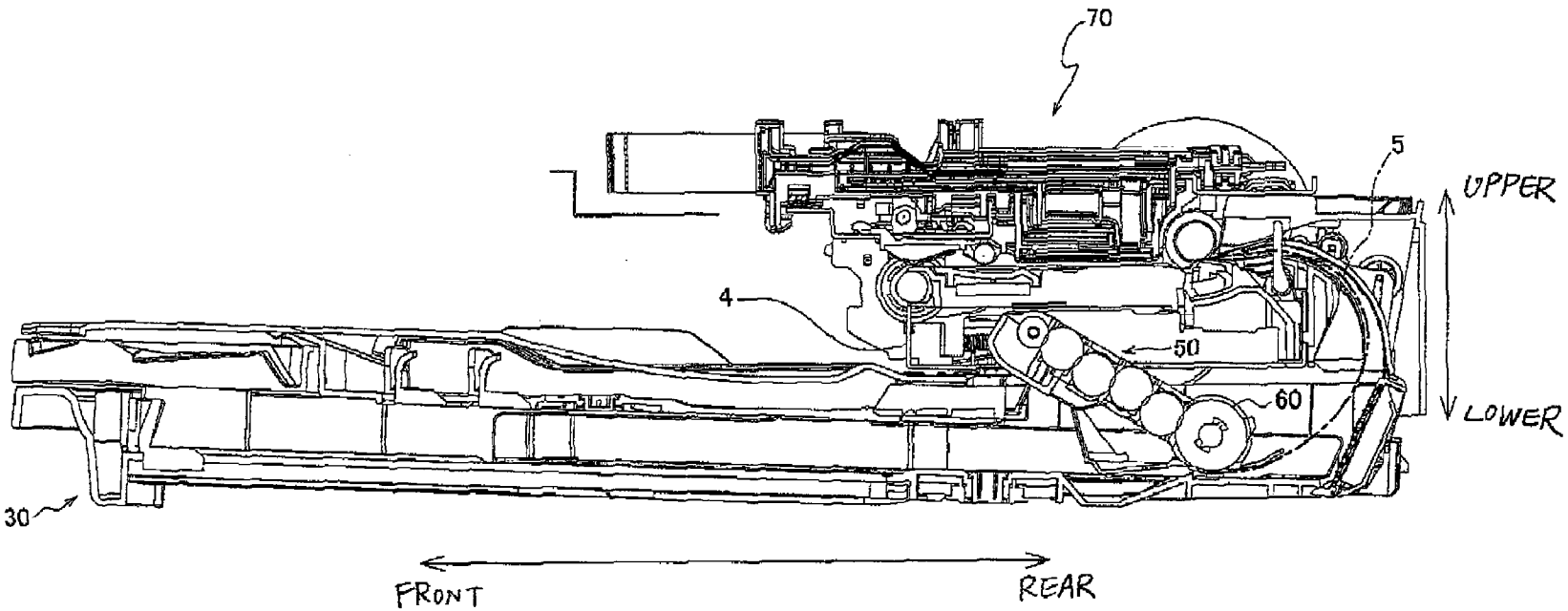
FIG. 2 is a vertical cross-sectional view of a sheet feeding unit and an image forming unit of the image forming apparatus according to the first embodiment.

As shown in FIG. 2, a sheet feeding tray 30 is arranged at a lower position in the inside of the main body casing 2. A plurality of recording sheets such as sheets of recording paper or OHP sheets are stacked and placed (accommodated) in the sheet feeding tray 30.

The sheet feeding tray 30 can be dismounted from the main body casing 2 by horizontally pulling the tray 30 out from an opening 2*a* (see FIG. 1) that is formed at the front surface of the main body casing 2. Reversely, the sheet feeding tray 30 can be mounted in the main body casing 2 by horizontally and rearwardly inserting the tray 30 from the opening 2*a* of the main body casing 2.

The sheet feeding unit 50 is a sheet feeding means for feeding (conveying) the recording sheets placed in the sheet feeding tray 30 one sheet at a time toward the image forming unit 70. The sheet feeding unit 50 is supported by a frame 4 that is fixed to the main body casing 2 at a position corresponding to the top side of the sheet feeding tray 30.

A conveying path 5 is formed at a rear end part of the main body casing 2 (at a position corresponding to the rear end of the sheet feeding tray 30). The conveying path 5 is adapted to turn the recording sheet fed (conveyed) toward the rear side from the sheet feeding tray 30 upward by about 180 degrees.

The image forming unit 70 is arranged at a position above the sheet feeding unit 50 in order to form (print) an image on the recording sheet that is conveyed (fed) to the image forming unit 70 by way of the conveying path 5. After forming an image on the recording sheet in the image forming unit 70, the recording sheet is discharged to a front side position on the top surface of the sheet feeding tray 30.

Since the image forming unit 70 is a known inkjet type image forming means, the image forming unit 70 will not be described in greater detail herein.

2. Configuration of Feeding Tray 30

Figure 3:
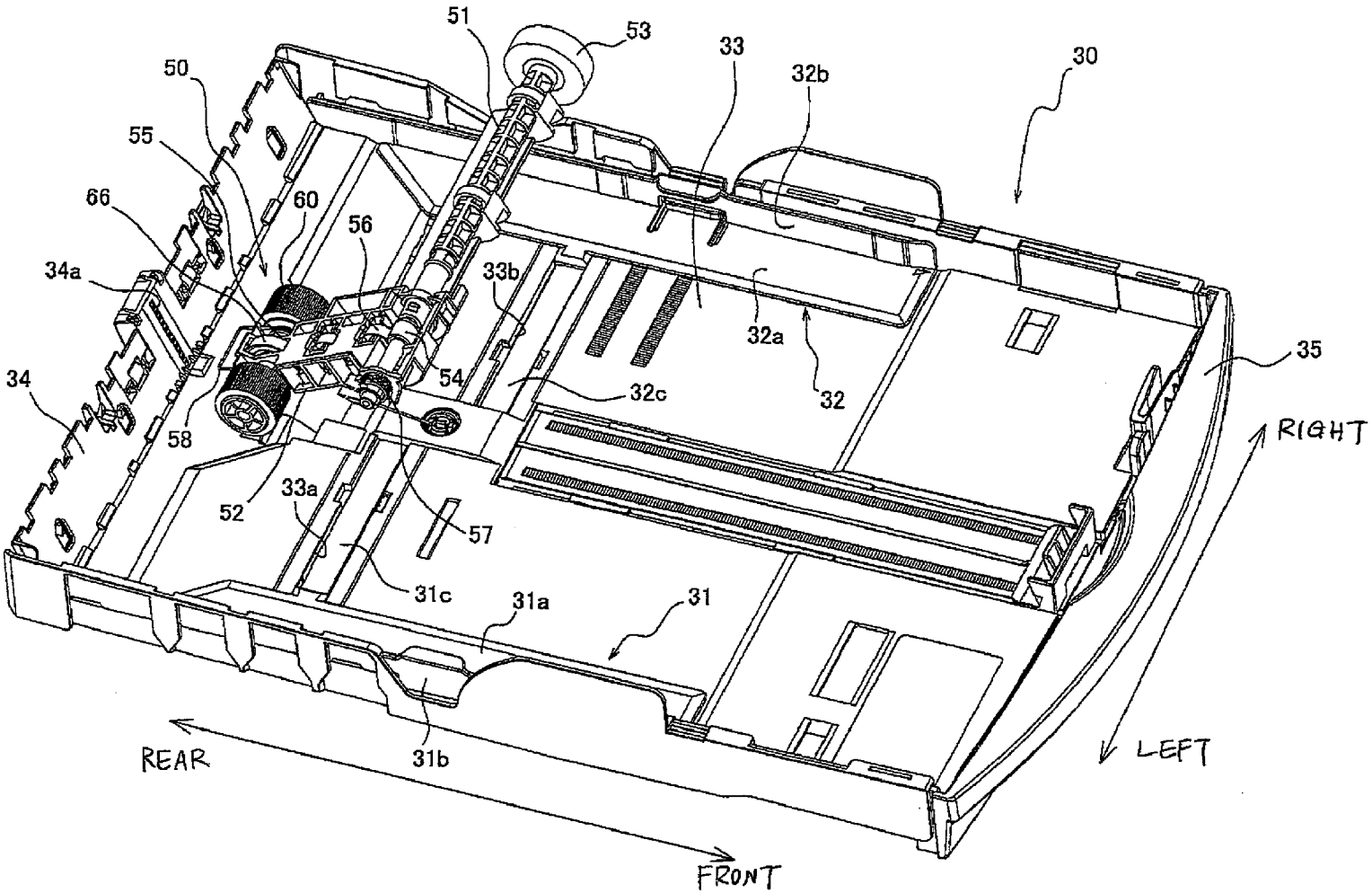
FIG. 3 is a perspective view of a feeding tray and the sheet feeding unit in which a second tray is not mounted.
Figure 4:
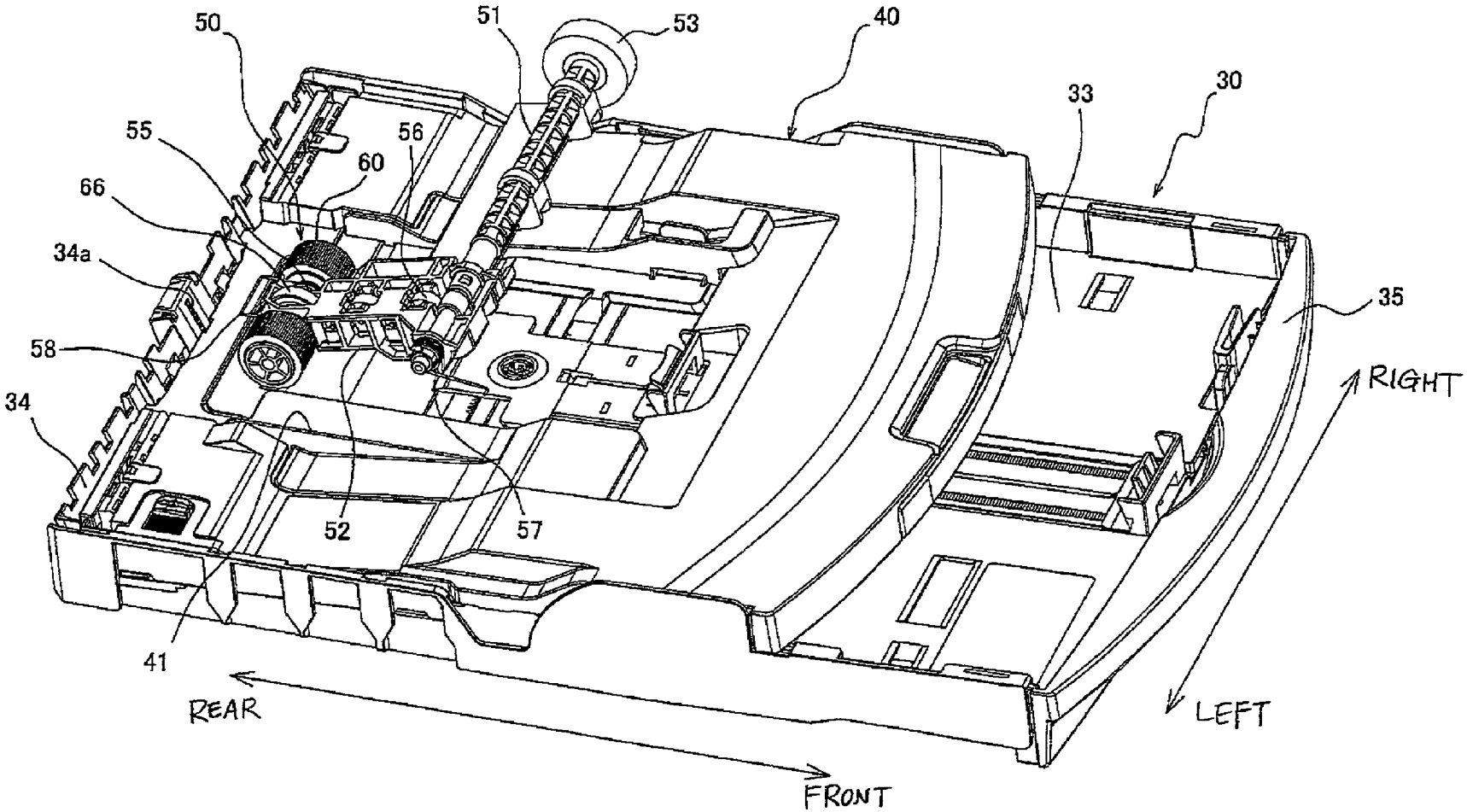
FIG. 4 is a perspective view of the feeding tray and the sheet feeding unit in which the second tray is mounted.

FIG. 3 is a perspective view of the sheet feeding tray 30 and the sheet feeding unit 50 in which a second tray 40 is not mounted. FIG. 4 is a perspective view of the sheet feeding tray 30 and the sheet feeding unit 50 in which the second tray 40 is mounted.

Figure 5:
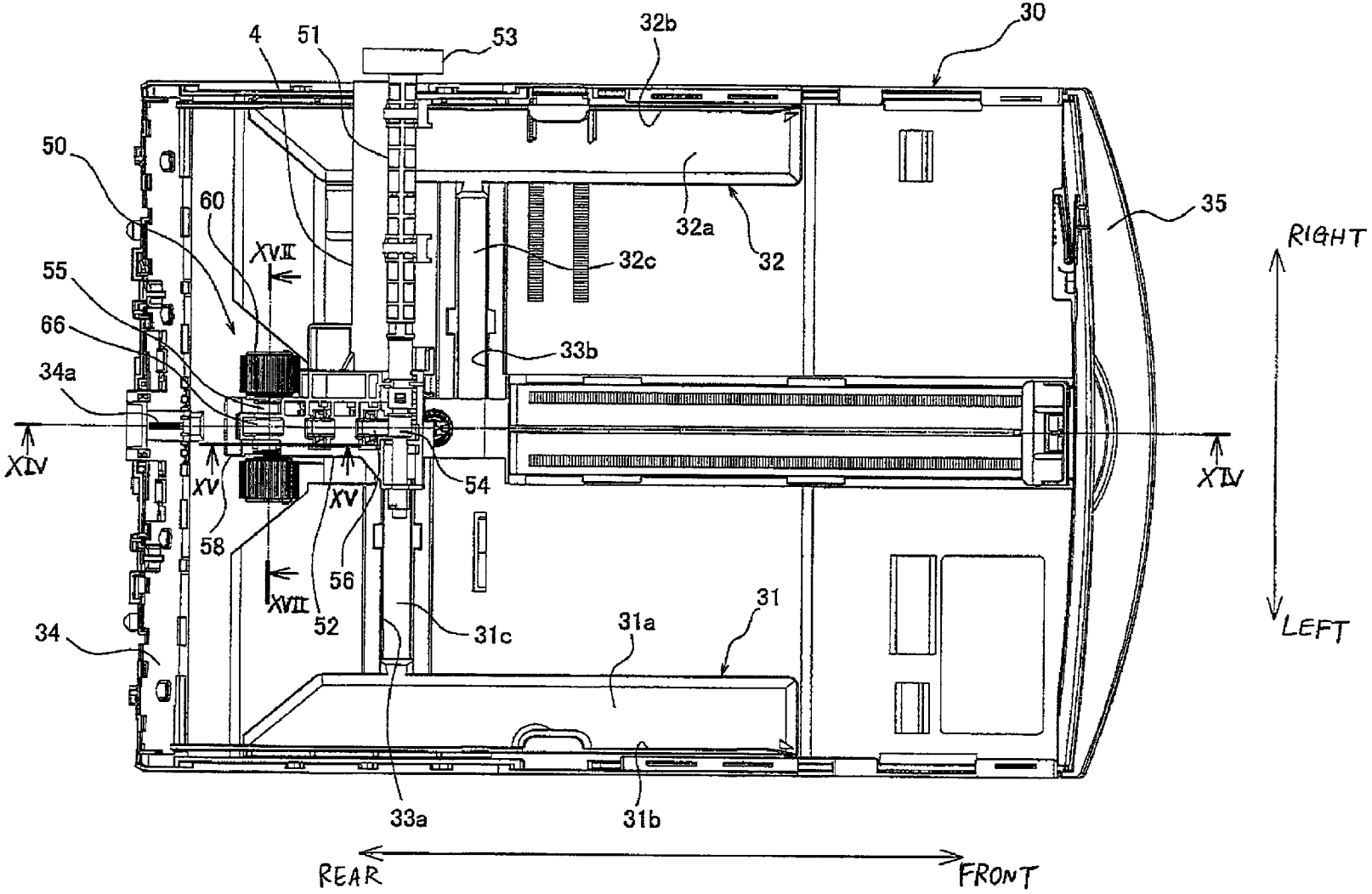
FIG. 5 is a plan view of the feeding tray and the sheet feeding unit as viewed from above in which the second tray is not mounted.
Figure 6:
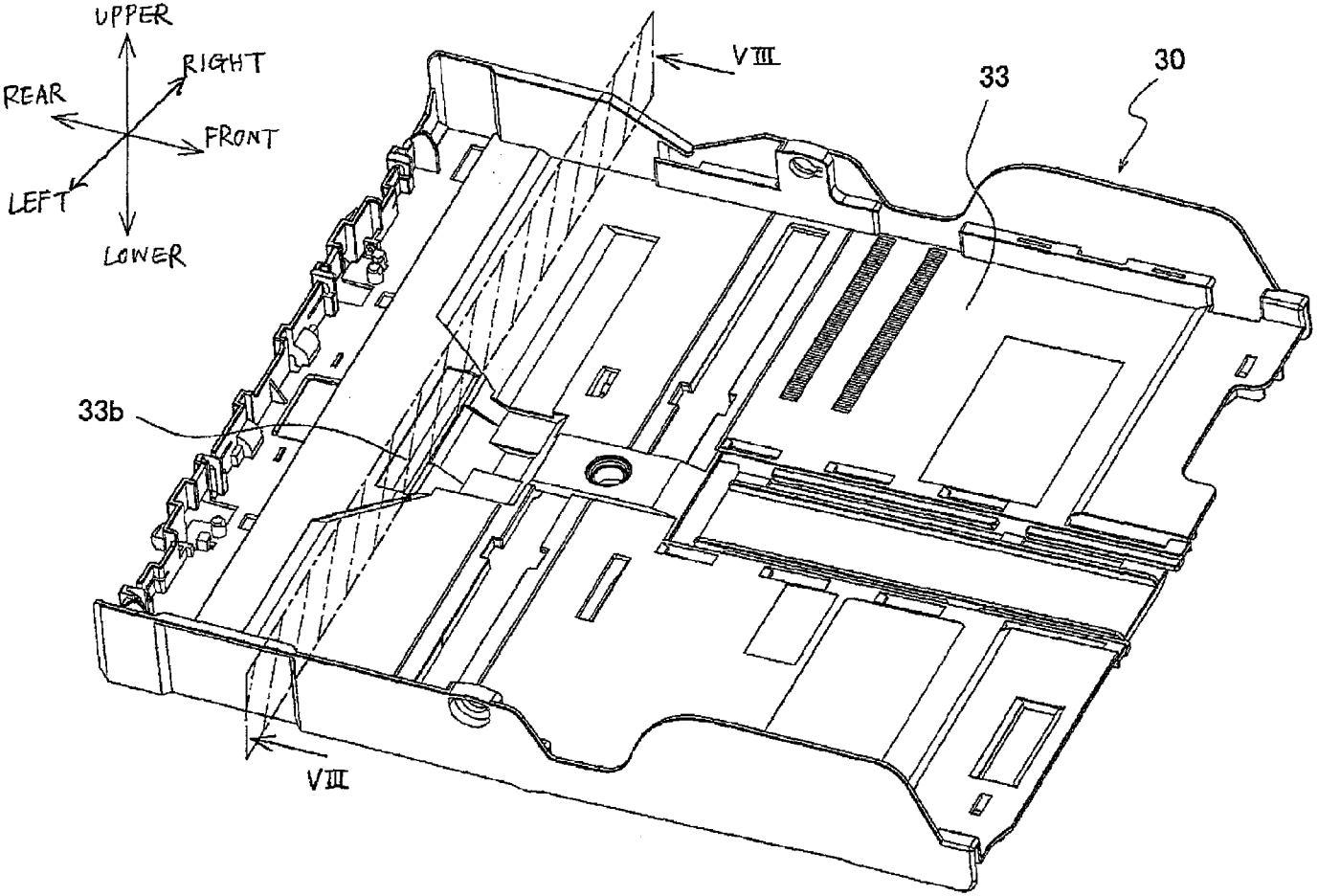
FIG. 6 is a perspective view of the sheet feeding tray as viewed from above, in which a grip part is removed.
Figure 7:
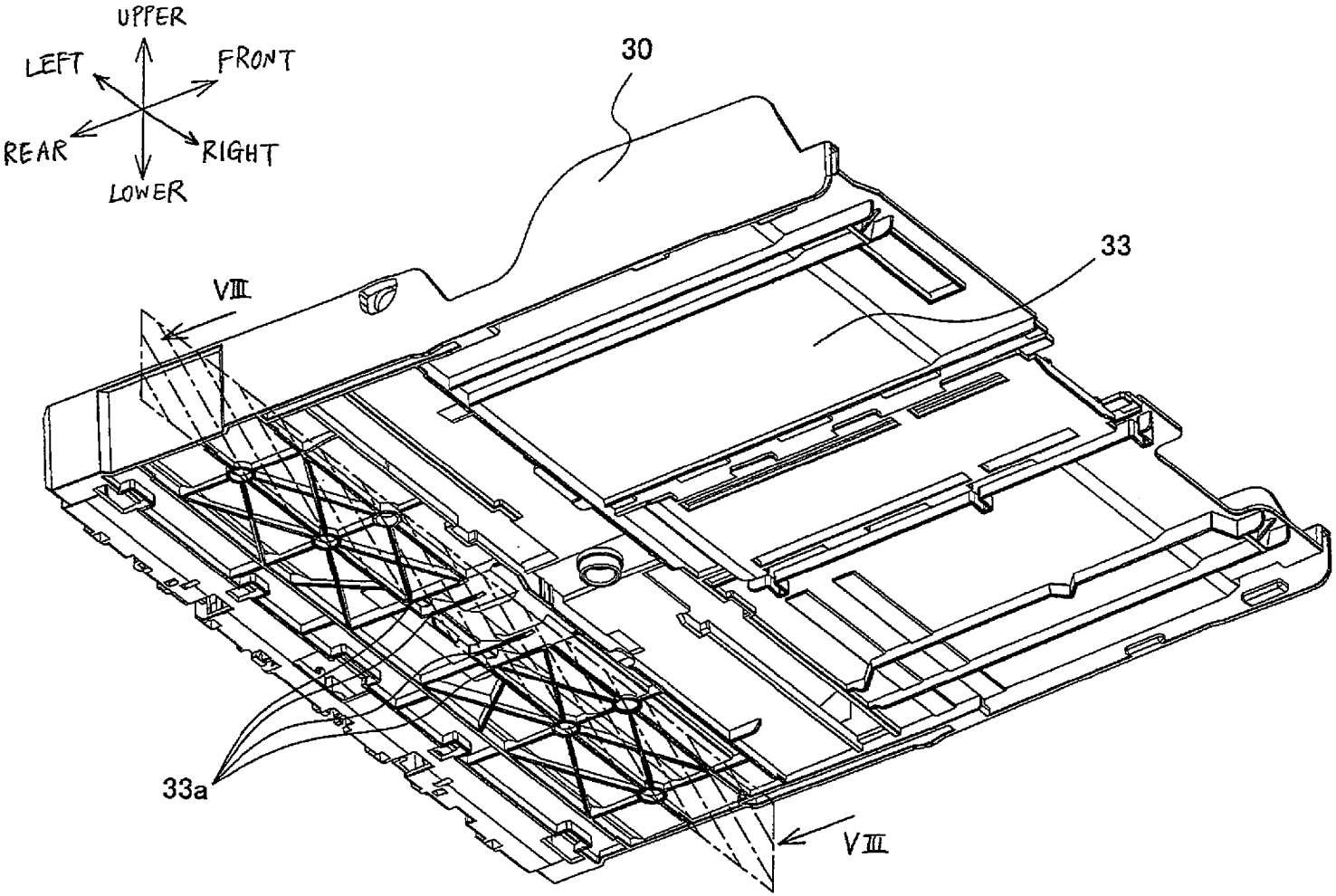
FIG. 7 is a perspective view of the sheet feeding tray as viewed from below, in which the grip part is removed.
Figure 8:
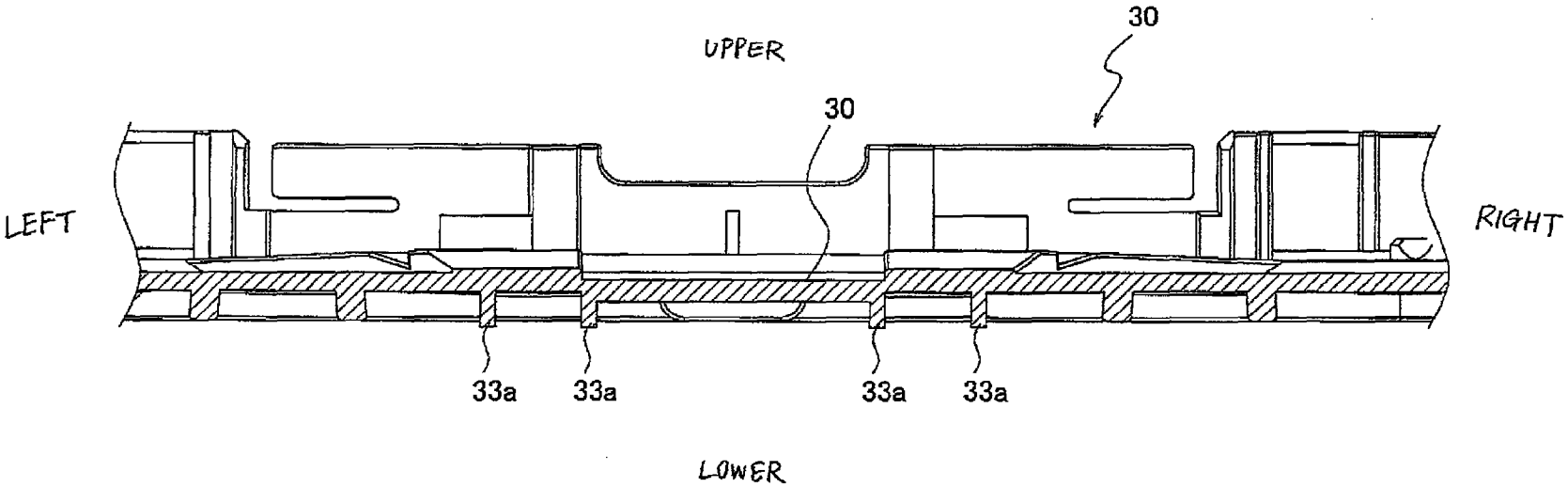
FIG. 8 is a cross-sectional view taken along a line VIII-VIII shown in FIGS. 6 and 7.

FIG. 5 is a plan view of the sheet feeding tray 30 and the sheet feeding unit 50 as viewed from above in which the second tray 40 is not mounted. FIG. 6 is a perspective view of the sheet feeding tray 30 as viewed from above, in which a grip part 35 is removed. FIG. 7 is a perspective view of the sheet feeding tray 30 as viewed from below, in which the grip part 35 is removed. FIG. 8 is a cross-sectional view taken along a line VIII-VIII shown in FIGS. 6 and 7.

Figure 9B:
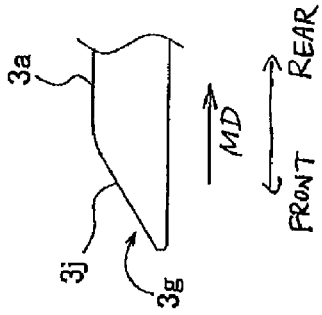
FIG. 9B is a cross-sectional view taken along a line IXB-IXB shown in FIG. 9A.
Figure 9A:
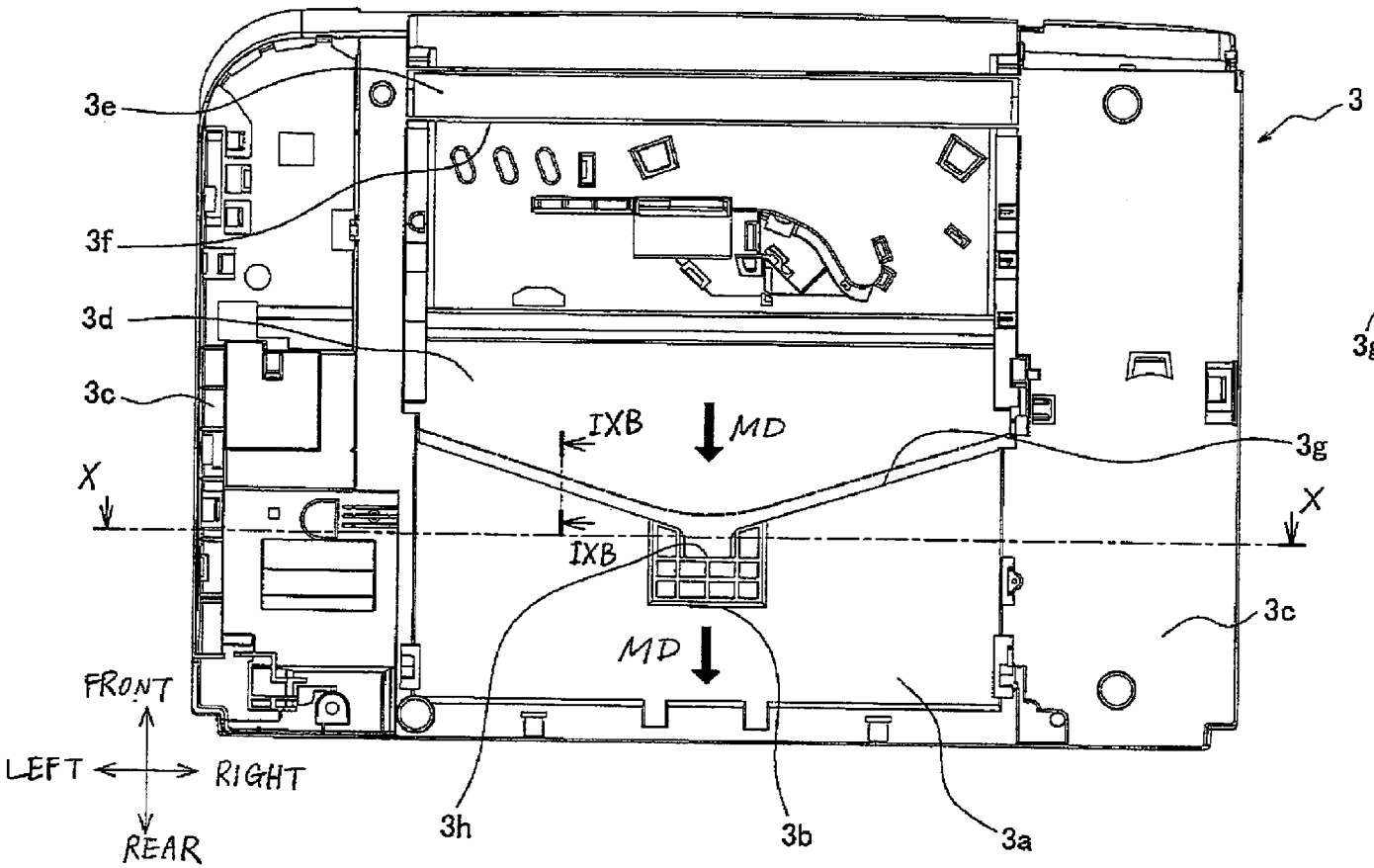
FIG. 9A is a bottom view of a base member that constitutes a lower part and side parts of a main body casing.
Figure 10:
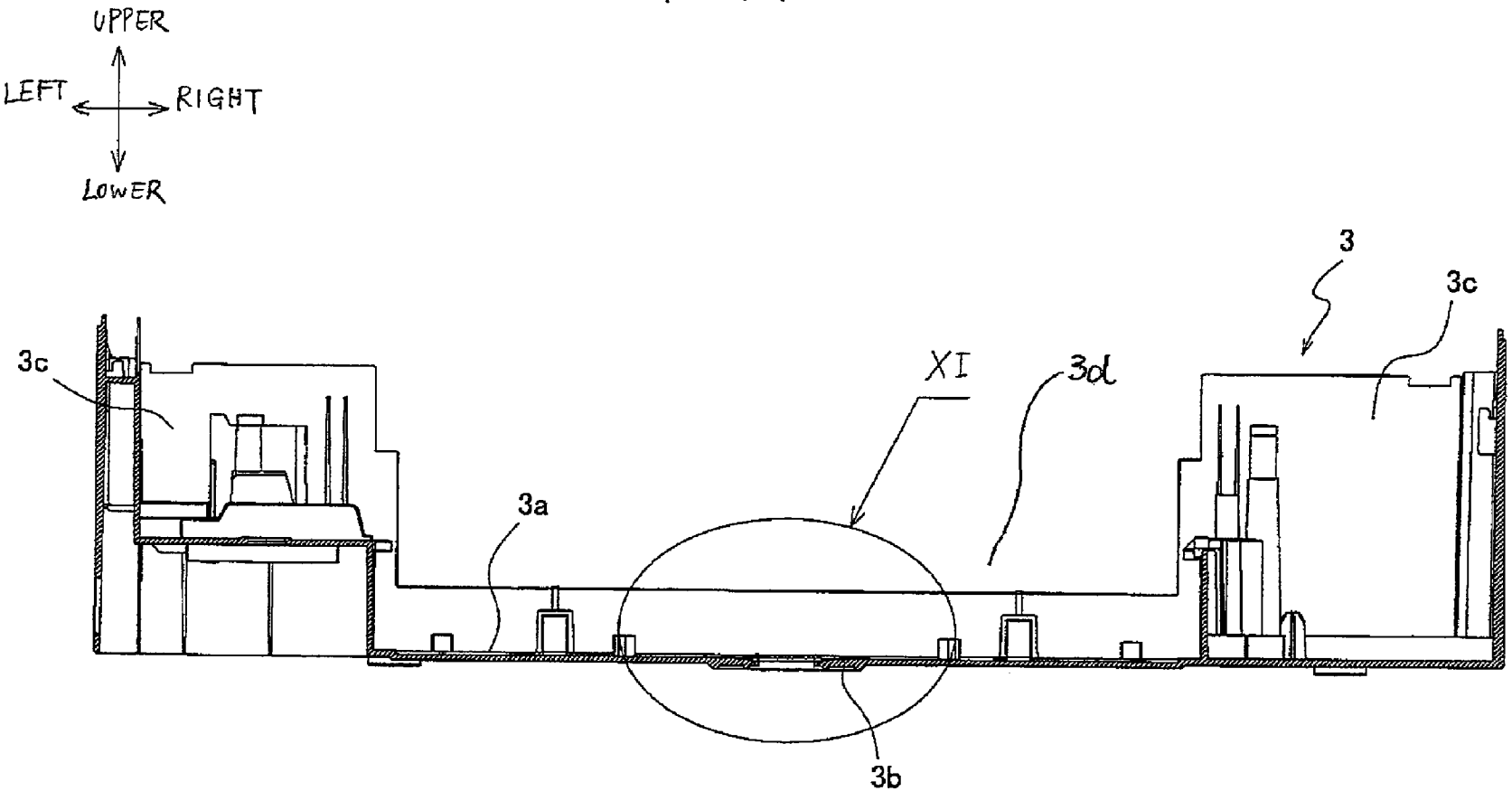
FIG. 10 is a cross-sectional view taken along a line X-X in FIG. 9A.
Figure 11:
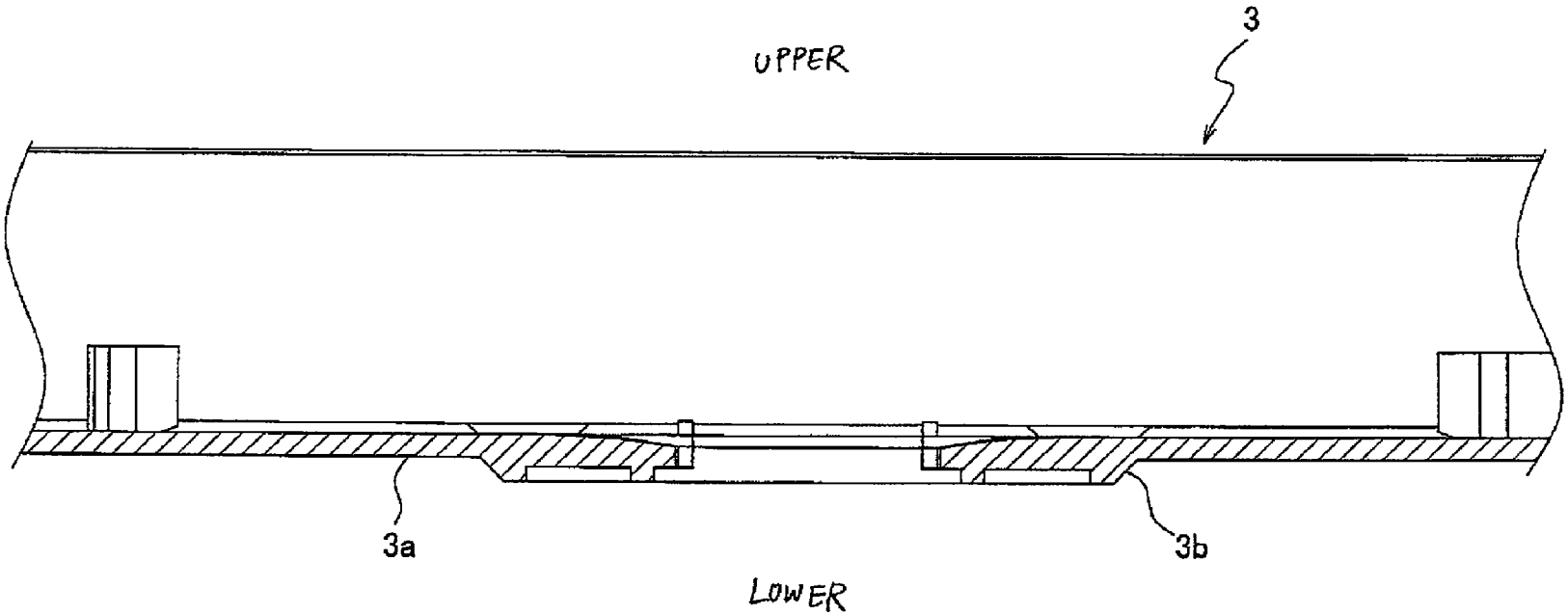
FIG. 11 is an enlarged schematic view of an encircled part XI in FIG. 10.
Figure 12:
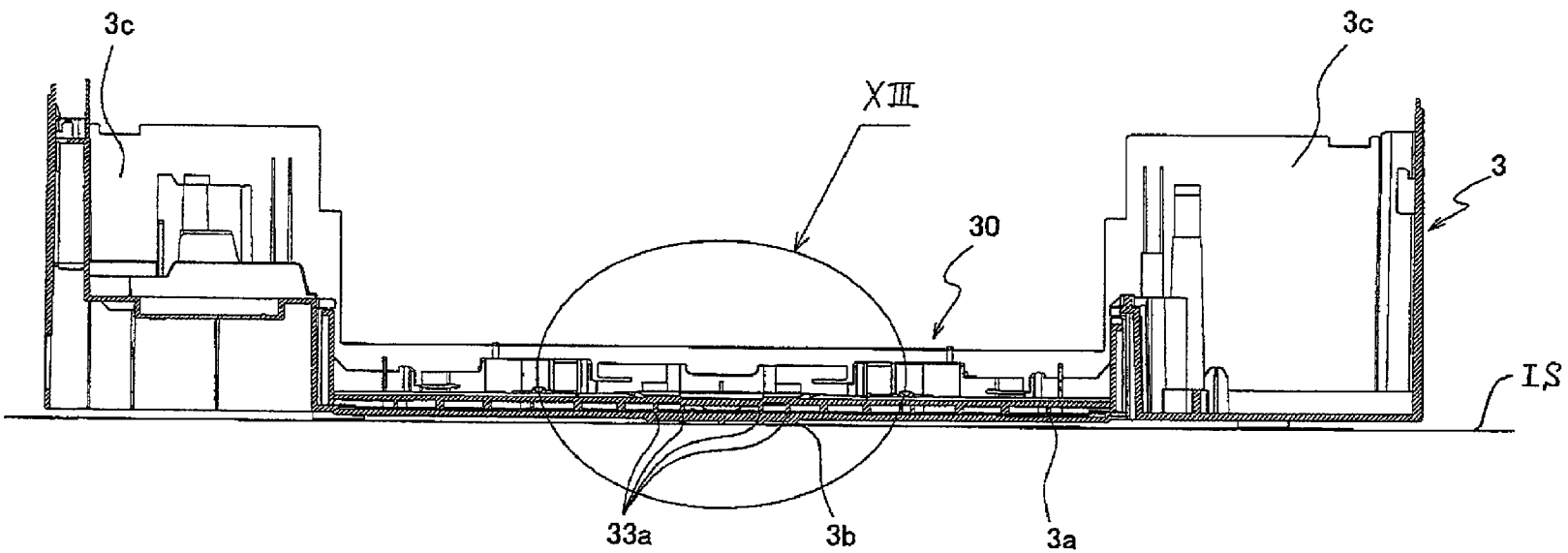
FIG. 12 is a cross-sectional view taken along the line X-X in FIG. 9A when the sheet feeding tray is mounted in the base member (main body casing)
Figure 13:
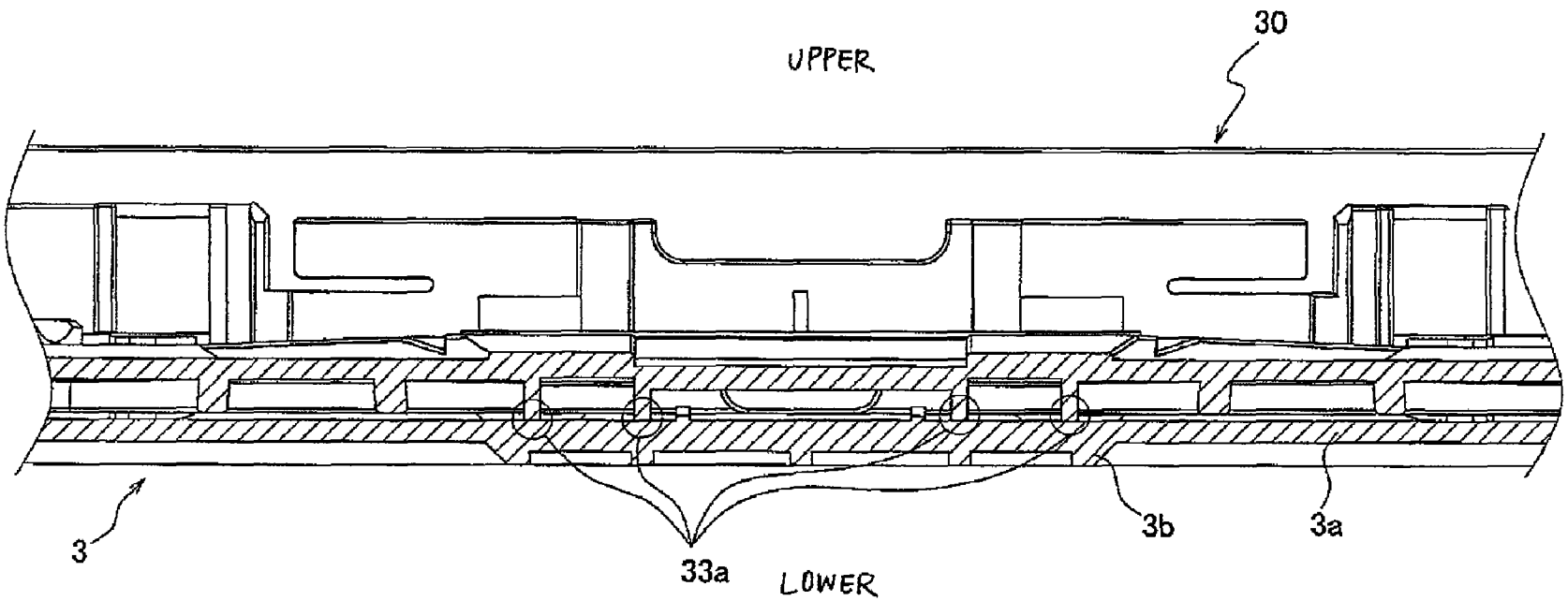
FIG. 13 is an enlarged schematic view of an encircled part XIII in FIG. 12.
Figure 14:
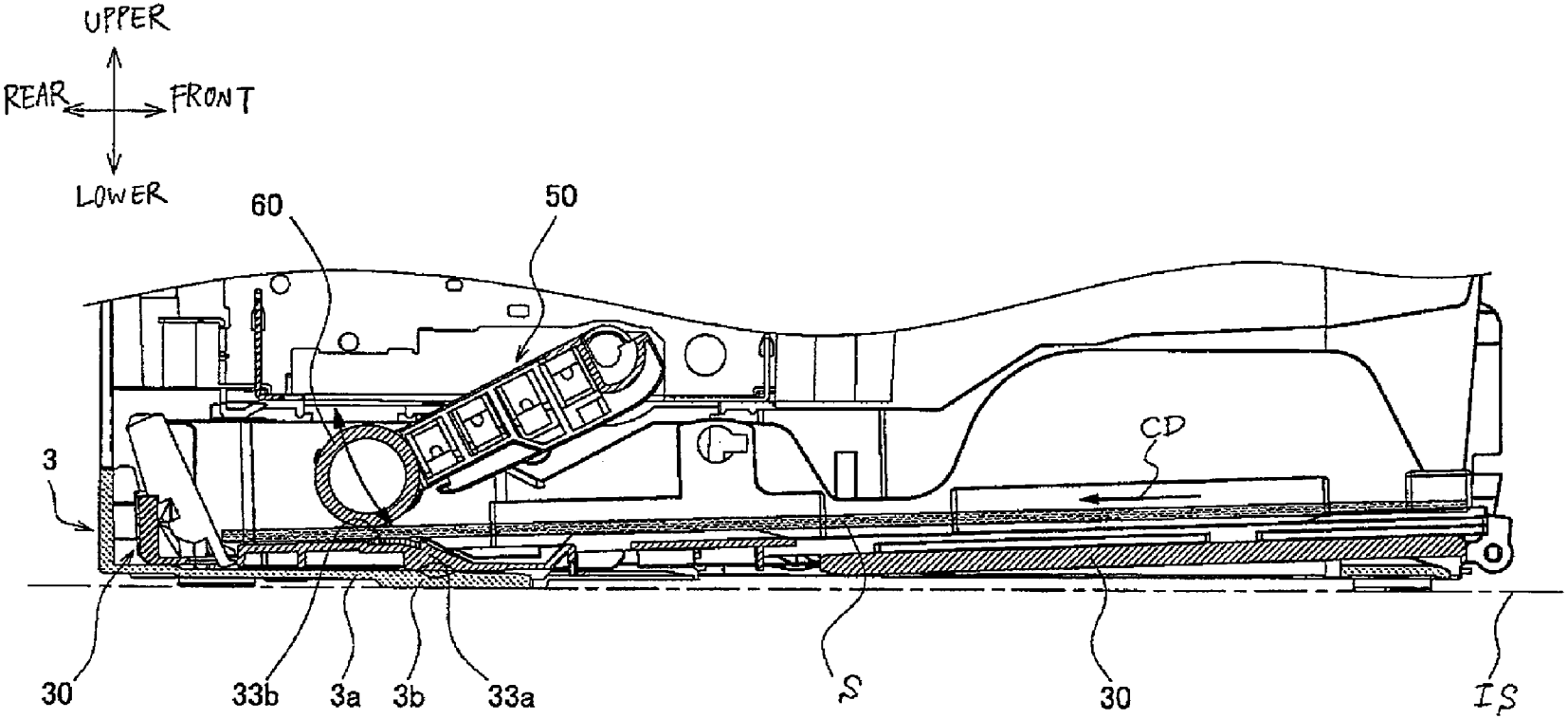
FIG. 14 is a cross-sectional view taken along a line XIV-XIV in FIG. 5.

FIG. 9A is a bottom view of a base member 3 that constitutes a lower part and side parts of the main body casing 2. FIG. 9B is a cross-sectional view taken along a line IXB-IXB shown in FIG. 9A. FIG. 10 is a cross-sectional view taken along a line X-X in FIG. 9A. FIG. 11 is an enlarged schematic view of an encircled part XI in FIG. 10. FIG. 12 is a cross-sectional view taken along the line X-X in FIG. 9A when the sheet feeding tray 30 is mounted in the base member 3 (the main body casing 2). FIG. 13 is an enlarged schematic view of an encircled part XIII in FIG. 12. FIG. 14 is a cross-sectional view taken along a line XIV-XIV in FIG. 5, in which the recording sheets S are placed in the sheet feeding tray 30.

As shown in FIGS. 3 and 5, the sheet feeding tray 30 is a thin rectangular tray member for receiving recording sheets to be placed thereon. In the present embodiment, the sheet feeding tray 30 is a resin-made part having size adapted to receive maximally A4-size recording sheets to be placed thereon.

The sheet feeding tray 30 is provided, at left and right ends thereof, with a pair of side end guides 31 and 32 that can be displaced in the left-right direction. The pair of side end guides 31 and 32 are adapted to be displaced in an interlocked manner in such a way that the center line of the pair of side end guides 31 and 32 is constantly located at the same position (on the widthwise center line of the sheet feeding tray 30 in the present embodiment) regardless of the displaced position of the pair of side end guides 31 and 32. Here, the widthwise direction is identical to the left-right direction.

More specifically, the side end guides 31 and 32 respectively have horizontal plate sections 31*a* and 32*a* on the top surfaces of which recording sheets are placed, vertical plate sections 31*b* and 32*b* standing vertically upward from the widthwise outer ends of the horizontal plate sections 31*a* and 32*a*; and linear guide bars 31*c* and 32*c* extending from the bottom surfaces of the horizontal plate sections 31*a* and 32*a* toward the other side end guides 31 and 32.

The two linear guide bars 31*c* and 32*c* are arranged in parallel with each other and separated from each other in the front-rear direction (in the conveying direction of recording sheets) and fitted into respective groove sections 33*a*, 33*b* formed to extend in the left-right direction in the bottom plate 33 of the sheet feeding tray 30. The two linear guide bars 31*c*, 32*c* are provided with respective rack gears (not shown) at the respective sides that face each other.

The rack gears are engaged with a pinion gear (not shown) arranged rotatably substantially at the center position, in the left-right direction, of the bottom plate 33 of the sheet feeding tray 30. Thus, the two side end guides 31 and 32 are mechanically interlocked with each other by way of the pinion gear so as to slide for displacement. In other words, the pair of side end guides 31 and 32 are interlocked and displaced so as to maintain the center position of the pair of lateral side guides 31, 32 constantly at the same position.

The parts of the vertical plate sections 31*b* and 32*b* that contact the respective left and right edges of recording sheets are formed as planes that extend in the front-rear direction (in the conveying direction). Thus, recording sheets are fed (conveyed) to the image forming unit 70 (the conveying path 5) as the recording sheets are aligned in the left-right direction by the side end guides 31 and 32.

A guide plate 34 is arranged at the downstream side of sheet feeding tray 30 (the bottom plate 33) in the conveying direction (at the rear end side of the sheet feeding tray 30). The guide plate 34 is for turning upward the conveying direction of the recording sheet which is provided with a conveying force by the sheet feeding unit 50. A metal-made separating member 34*a* is arranged at a center part of the guide plate 34 in the left-right direction.

The separating member 34*a* includes a plurality of protrusions arranged vertically at predetermined regular intervals. Each of the protrusions protrudes slightly from the front surface of the guide plate 34. Thus, the leading ends of a plurality of recording sheets that are pushed toward the guide plate 34 by the sheet feeding unit 50 are subjected to conveying resistance by contacting the front end of the separating member 34*a* (the protrusions). Then, the recording sheet that is positioned uppermost is separated from the other recording sheets and conveyed (fed) to the image forming unit 70 one sheet at a time.

As shown in FIG. 4, the grip part 35 is arranged at the upstream side of the conveying direction of the sheet feeding tray 30 (the bottom plate 33), that is, at the front end side of the sheet feeding tray 30. The grip part 35 is for being gripped by user's hand when the sheet feeding tray 30 is mounted and dismounted.

As shown in FIG. 8, support ribs 33*a* (supporting member) are arranged at the bottom surface of the bottom plate 33 to support the bottom plate 33 against the pressure applied to the recording sheets by the sheet feeding roller 60. The support ribs 33*a* are a plurality of ribs protruding from the underside of the bottom plate 33, Each of the support ribs 33*a* extends in the front-rear direction (the conveying direction for conveying the recording sheet).

As shown in FIGS. 6 and 14, a separating pad 33*b* is arranged at the surface (top surface) side of the bottom plate 33 to contact the recording sheet placed on the sheet feeding tray 30 and produce a predetermined level of conveying resistance. The separating pad 33*b* is located at a position that corresponds to the position of contact between the sheet feeding roller 60 (described later) and the recording sheet.

The support ribs 33*a* of the present embodiment are arranged at the upstream side relative to the separating pad 33*b* in the conveying direction CD (feeding direction) of the recording sheet, that is, at the upstream side relative to the sheet feeding roller 60 in the conveying direction CD.

In the present embodiment, the bottom plate 33 and the support ribs 33*a* are made of synthetic resin. Additionally, the bottom plate 33 and the support ribs 33*a* are molded integrally. In other words, the support ribs 33*a* are formed as integral parts of the bottom plate 33.

As shown in FIGS. 9A and 14, a base member 3 constitutes bottom and side parts of the main body casing 2 (FIG. 1). The sheet feeding tray 30 is accommodated in the main body casing 2 in a state where the sheet feeding tray 30 is mounted in the base member 3. The base member 3 has a support plate 3*a* (base-side supporting member) in an area that corresponds to the support ribs 33*a*. The support plate 3*a* contacts the support ribs 33*a*, and receives pressure applied to the recording sheet by the sheet feeding roller 60.

The support plate 3*a* has a thick part 3*b* that is made thicker than the remaining part thereof at a position that corresponds to the support ribs 33*a*. In the present embodiment, the thick part 3*b* is integrally formed with the support plate 3*a* in such a manner that the thick part 3*b* protrudes from the lower surface of the support plate 3*a*, which is the surface opposite to the surface facing the support ribs 33*a*.

As shown in FIGS. 9A and 10, the base member 3 has accommodating sections 3*c* for accommodating the sheet feeding unit 50, a drive source (not shown) such as an electric motor for driving the conveying roller and other components, and a control device for controlling the drive source and the image forming unit 70. The accommodating sections 3*c* are arranged at both sides of the base member 3 with a space 3*d* for receiving the sheet feeding tray 30 therebetween.

The support plate 3*a* is a plate-shaped member that extends substantially in parallel with the bottom plate 33 and links the accommodating sections 3*c* arranged at opposite sides of the base member 3 with the space 3*d* therebetween in an area near the rear end of the base member 3 (toward which the sheet feeding tray 30 is pushed when the tray 30 is mounted). On the other hand, the accommodating sections 3*c* are linked to each other by a bridge section 3*f* that is reinforced by a metal plate 3*e* in an area near the front end of the base member 3 (the upstream side in the mounting direction MD for mounting the sheet feeding tray 30).

In the present embodiment, the base member 3 is integrally formed of the support plate 3*a*, the thick part 3*b*, and the accommodating sections 3*c* by molding resin.

As shown in FIG. 9A (note that FIG. 9A is a bottom view of the base member 3 as viewed from below), a cutout section 3*g* is provided at the front end of the support plate 3*a* (the upstream side in the mounting direction MD for mounting the sheet feeding tray 30). The cutout section 3*g* has a substantially V-shape in plan view that is convex in the mounting direction MD. An apex 3*h* of the cutout section 3*g* is located at a position where the sheet feeding roller 60 and the recording sheet contact with each other (substantially at the center in the left-right direction in the present embodiment).

Rail sections (not shown) are provided at the both ends of the support plate 3*a* in the left-right direction. The rail sections slidably support the left and right ends of the sheet feeding tray 30. As shown in FIG. 9B, the cutout section 3*g* includes a tapered section 3*j* that extends along the entire length of the cutout section 3*g* as indicated by the thick two-dot chain line in FIG. 9A. The thickness of the tapered section 3*j* decreases toward the front end (the upstream side in the mounting direction MD).

As shown in FIG. 4, the sheet feeding tray 30 of the present embodiment includes the second tray 40 for receiving small recording sheets such as postcards and envelopes that are thicker and smaller than ordinary sheets of copying paper at a predetermined position (substantially at the center in the left-right direction in the present embodiment). The second tray 40 is detachably mounted on the top side of the sheet feeding tray 30.

3. Configuration of Sheet Feeding Unit 50

Figure 15:
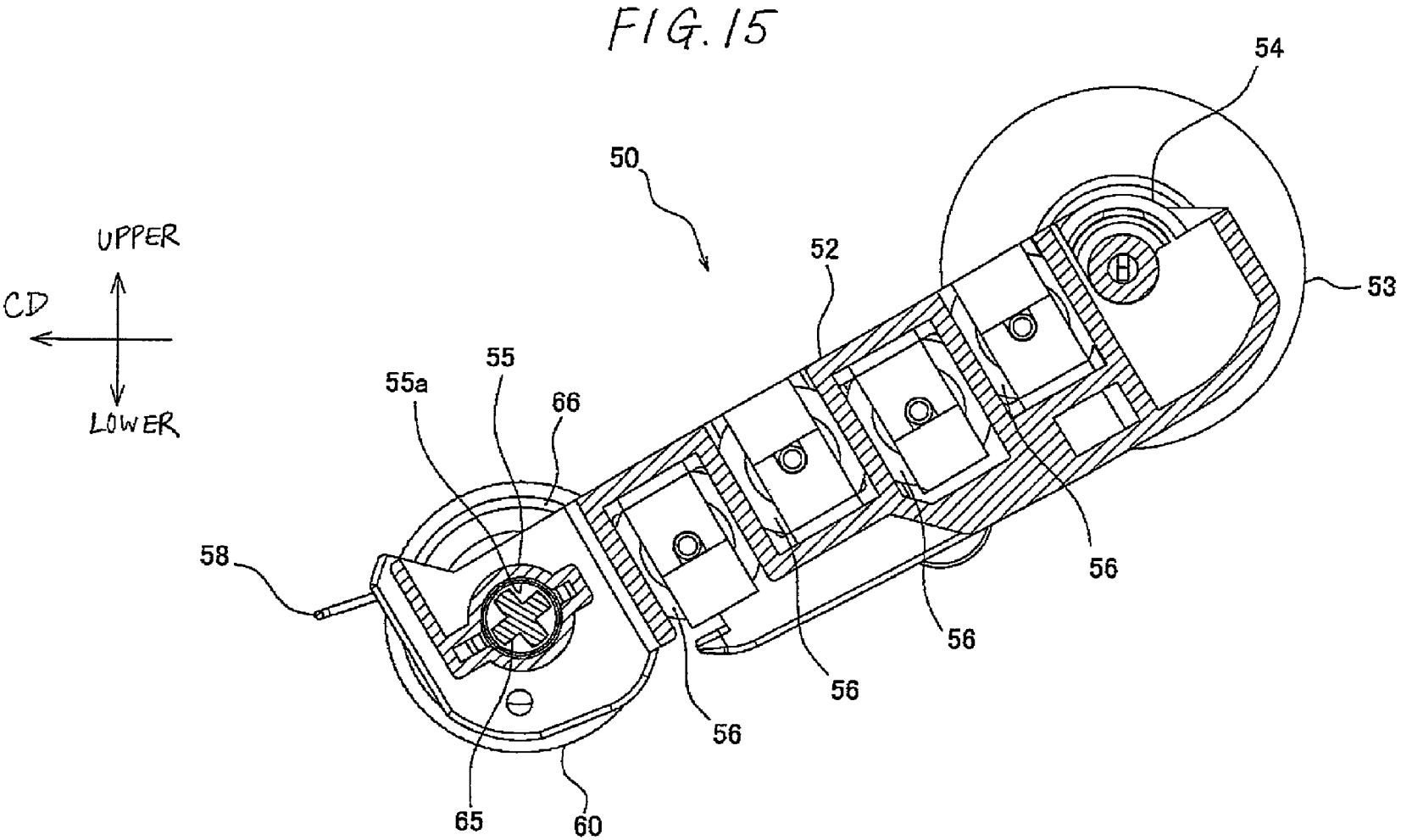
FIG. 15 is a cross-sectional view of the sheet feeding unit taken along a line XV-XV in FIG. 5.
Figure 16:
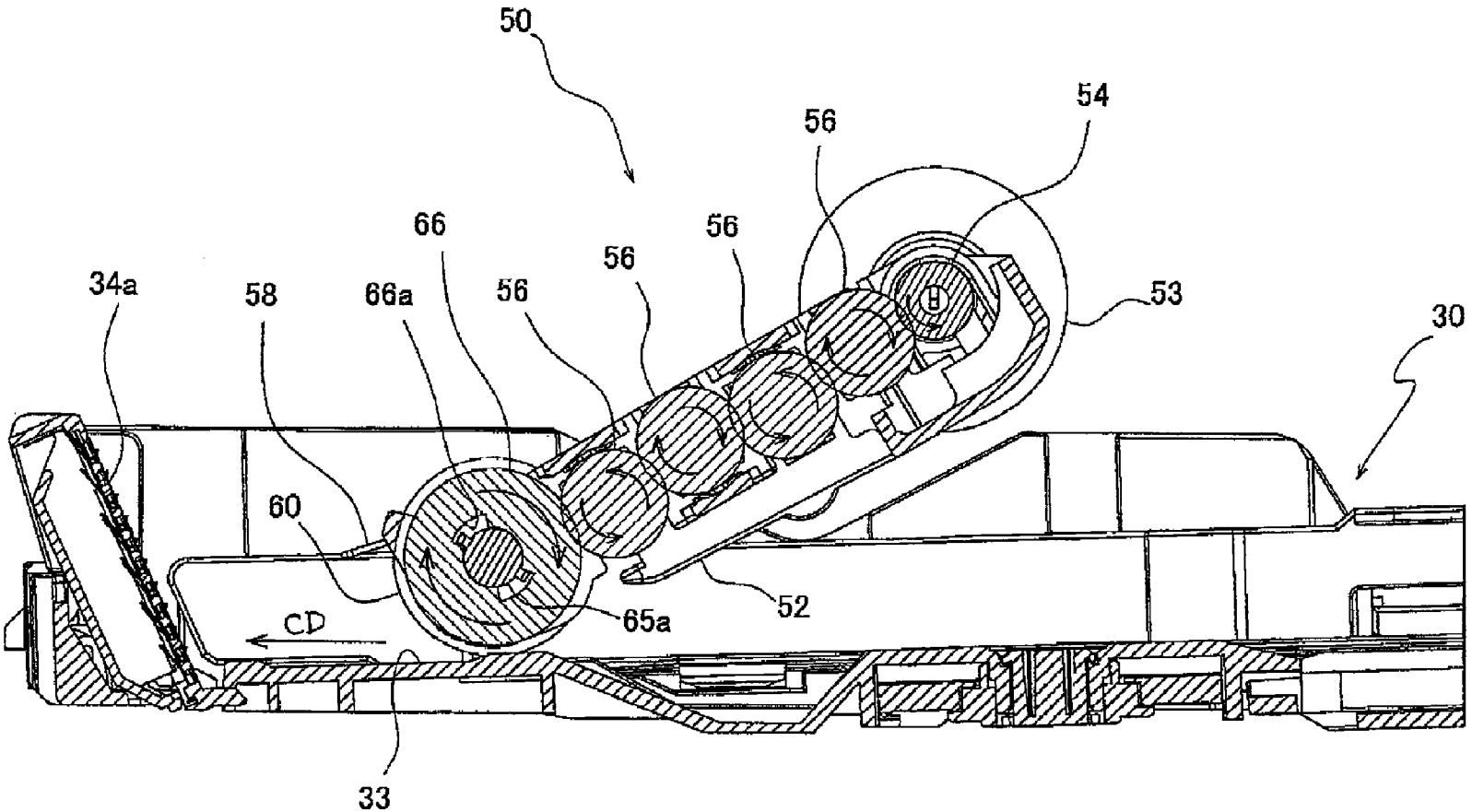
FIG. 16 is a cross-sectional view of the sheet feeding unit taken along the line XIV-XIV in FIG. 5.
Figure 17A:
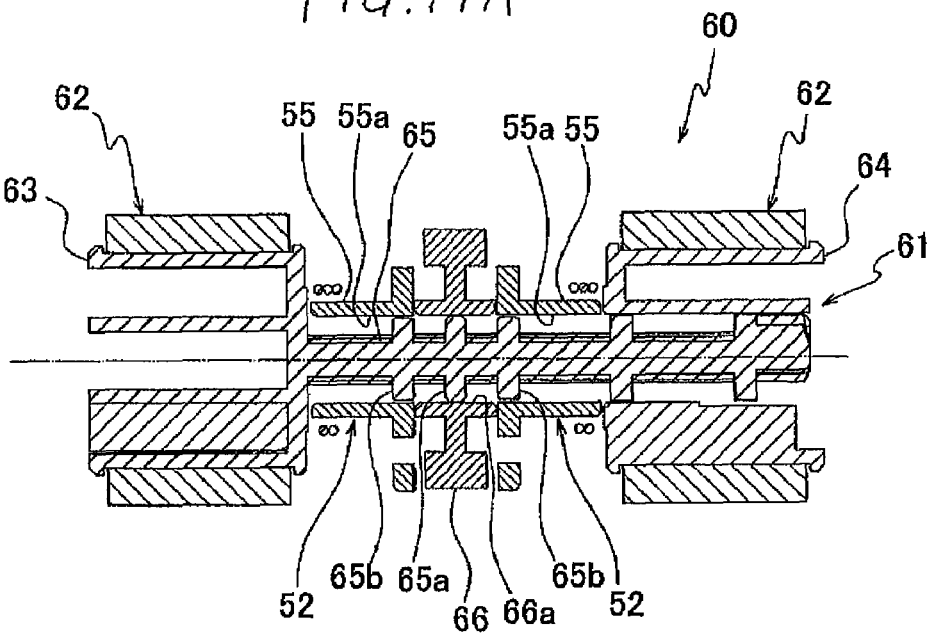
FIG. 17A is a cross-sectional view of a sheet feeding roller taken along a line XVII-XVII in FIG. 5, in which the sheet feeding roller (rotational shaft) is disposed in parallel with a center line of a through hole.
Figure 17B:
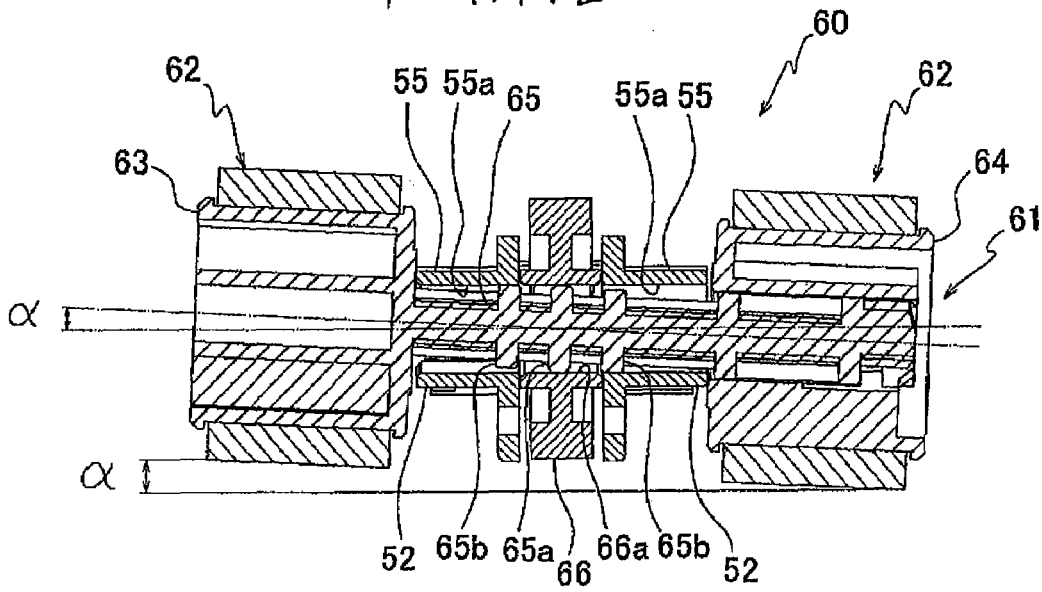
FIG. 17B is a cross-sectional view of the sheet feeding roller taken along the line XVII-XVII in FIG. 5, in which the sheet feeding roller (rotational shaft) is inclined relative to the center line of the through hole.
Figure 18A:
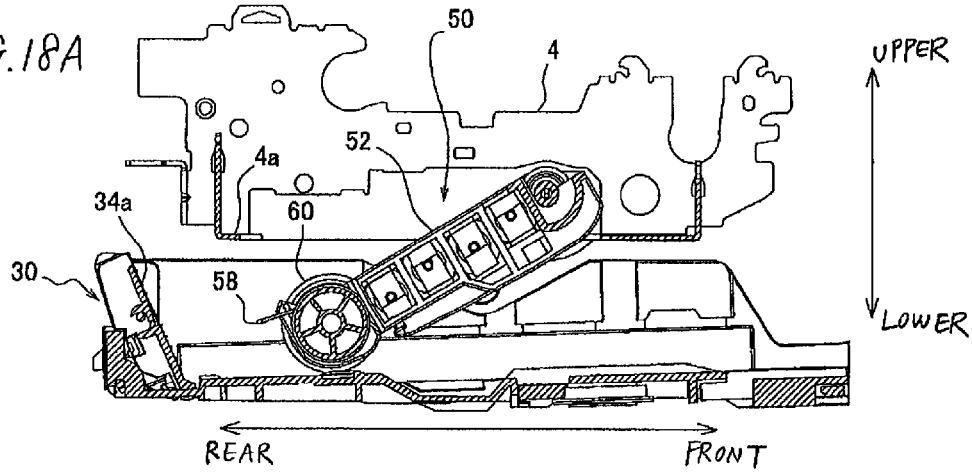
FIG. 18A is a vertical cross-sectional view for showing how a second torsion coil spring operates, where a roller arm is positioned on a bottom surface of the sheet feeding tray.
Figure 18B:
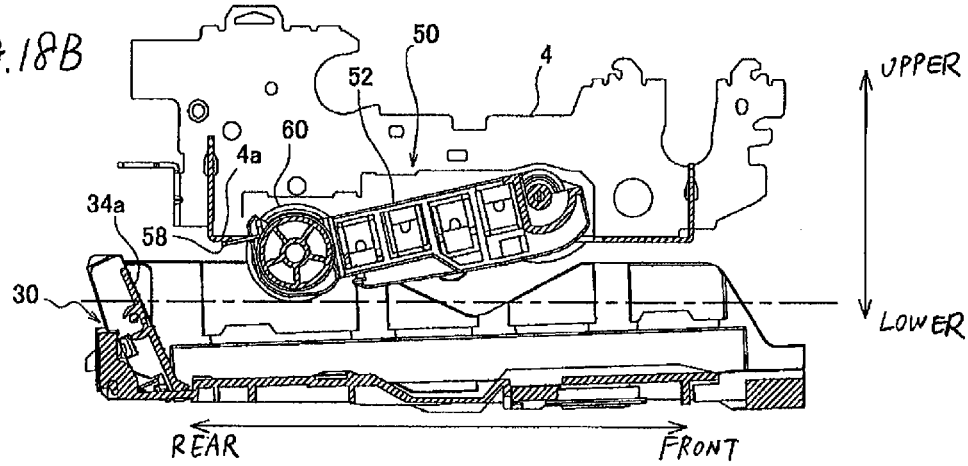
FIG. 18B is a vertical cross-sectional view for showing how the second torsion coil spring operates, where the roller arm is positioned on a bottom surface of the second tray.
Figure 18C:
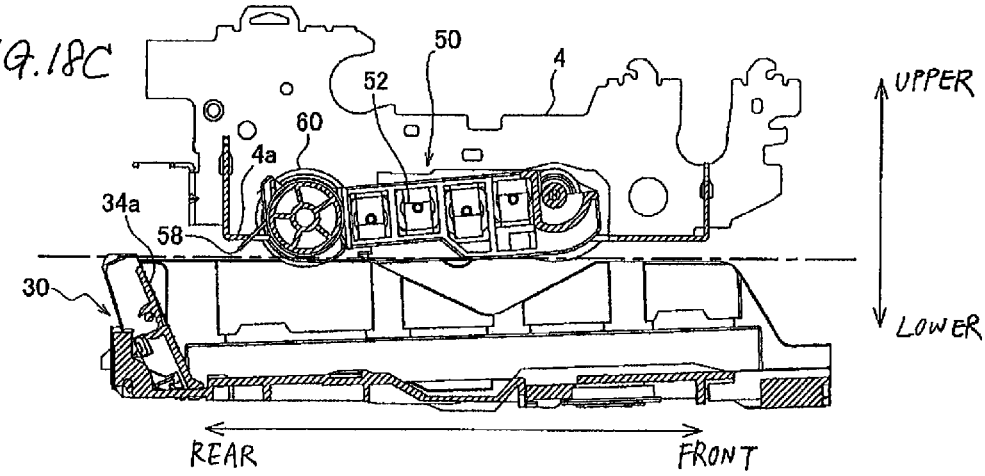
FIG. 18C is a vertical cross-sectional view for showing how the second torsion coil spring operates, where the roller arm is positioned on an uppermost recording sheet when recording sheets are accommodated in the second tray to full capacity.
Figure 19:
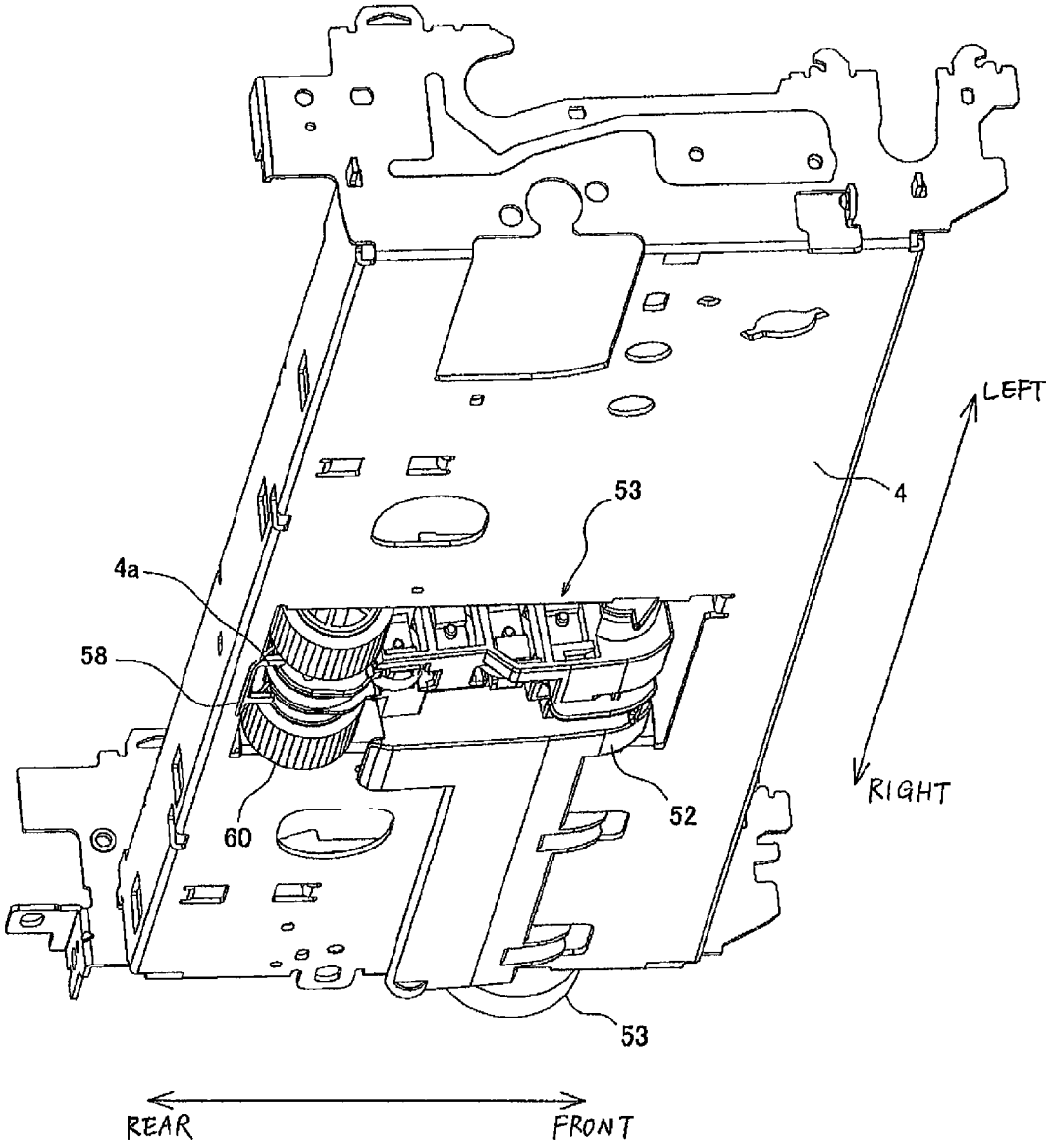
FIG. 19 is a perspective view of the sheet feeding unit as viewed from below.

FIG. 15 is a cross-sectional view of the sheet feeding unit 50 taken along a line XV-XV in FIG. 5. FIG. 16 is a cross-sectional view of the sheet feeding unit 50 taken along the line XIV-XIV in FIG. 5. FIGS. 17A and 17B are cross-sectional views of the sheet feeding roller 60 taken along a line XVII-XVII in FIG. 5, wherein FIG. 17A shows a state where the sheet feeding roller 60 (rotational shaft 65) is disposed in parallel with a center line of a through hole 55*a* and FIG. 17B shows a state where the sheet feeding roller 60 (rotational shaft 65) is inclined relative to the center line of the through hole 55*a*. FIGS. 18A through 18C are vertical cross-sectional views for showing how a second torsion coil spring 58 operates. FIG. 19 is a perspective view of the sheet feeding unit 50 as viewed from below.

The sheet feeding unit 50 is a conveying means for feeding (conveying) recording sheets toward the image forming unit 70, applying a conveying force to the recording sheet placed on the sheet feeding tray 30. As shown in FIG. 5, the sheet feeding unit 50 is supported by a support shaft 51 so as to be able to swing about the support shaft 51. The support shaft 51 is located above the sheet feeding tray 30 and extends from a widthwise center position of the sheet feeding tray 30 toward one end (the right end in the present embodiment).

The support shaft 51 is supported by a metal frame 4. The radial component of an external force applied to the support shaft 51 is received mainly by the frame 4, whereas the torque applied to the support shaft 51 is mainly transmitted or received by the support shaft 51 itself.

A large gear 53 is arranged at a position that corresponds to the axial end of the support shaft 51 located at the one end (the right end in the present embodiment) of the sheet feeding tray 30 to transmit a rotational force from the drive source to the support shaft 51. On the other hand, a small gear 54 is arranged at a position that corresponds to the axial end of the support shaft 51 located at the widthwise center position of the sheet feeding tray 30 so as rotate with the support shaft 51.

A roller arm 52 is swingably supported by the support shaft 51 and extends in a radial direction of the support shaft 51. The sheet feeding roller 60 is supported by the distal end of the roller arm 52 so as to be rotatable about a rotational shaft 65 (see FIGS. 17A and 17B) that extends in parallel with the support shaft 51. Thus, as the roller arm 52 is swingably moved about the support shaft 51 and swings toward the bottom plate 33 (recording sheets), the sheet feeding roller 60 is pushed onto the recording sheets to cause pressure that presses the sheet feeding roller 60 against the recording sheet.

On the other hand, the sheet feeding roller 60 is a conveying means for applying a conveying force to the recording sheet as the roller rotatingly contacts the uppermost recording sheet placed on the sheet feeding tray 30. As shown in FIGS. 17A and 17B, the sheet feeding roller 60 includes a main body member 61 that is a shaft and roller members 62 fitted to the both axial ends of the main body member 61.

In the present embodiment, the main body member 61 is made of hard synthetic resin and the roller members 62 are made of a rubber or resin material that has a large coefficient of friction and is resiliently deformable.

The sheet feeding roller 60 also includes cylindrical roller support sections 63 and 64 to which the roller members 62 are fitted respectively and a rod-shaped rotational shaft 65 that links the roller support sections 63 and 64. A gear contact section 65*a* is provided at the axial center position of the rotational shaft 65. Arm contact sections 65*b* are arranged at the both sides of the gear contact section 65*a*.

As shown in FIG. 15, the rotational shaft 65 has a substantially cross-shaped cross section. On the other hand, as shown in FIG. 16, the gear contact section 65*a* has a cross section that includes a circular shaft part having a diameter greater than the largest radial dimension of the rotational shaft 65 and protruding parts that radially protrude from the circular shaft part at opposite positions. The arm contact sections 65*b* have a circular cross section having a diameter greater than the largest diameter of the rotational shaft 65.

As shown in FIGS. 17A and 17B, a through hole 55*a* for receiving the rotational shaft 65 is formed at the distal end of the roller arm 52. In other words, the through hole 55*a* operates to form shaft supporting sections 55 for rotatably supporting the rotational shaft 66 (the sheet feeding roller 60).

Thus, the rotational shaft 65 is rotatably supported by the shaft supporting sections 55 as the outer peripheral surfaces of the arm contact sections 65*b* slidably contact the inner peripheral surface of the through hole 55*a*.

As shown FIG. 17B, since the outer diameter of the arm contact sections 65*b* is slightly smaller than the inner diameter of the through hole 55*a*, the rotational shaft 65 can rotate in a state where the rotational shaft 65 is slightly inclined relative to the center axis of the through hole 55*a*. An angle of inclination a is approximately 3 degrees, for example.

A drive gear 66 is rotatably fitted to the roller arm 52 between the two shaft supporting sections 55 and adapted to transmit a drive force to the sheet feeding roller 60 (the rotational shaft 65). As shown in FIG. 16, the gear contact section 65*a* is arranged in the through hole 66*a* where the center of rotation of the drive gear 66 is located.

A sector-shaped cutout section (a recessed section) is formed at part of the peripheral surface of the through hole 66*a* and the protruding section of the gear contact section 65*a* is received in the cutout section. In other words, the cutout section (the recessed section) of the through hole 66*a* and the protruding section of the gear contact section 65*a* are engaged with each other.

In the present embodiment, the length of the arc of the sector-shaped cutout section (the recessed section) is made greater than the length of the arc of the protruding section of the gear contact section 65*a* so that the gear contact section 65*a* (the rotational shaft 65) has a play by a predetermined angle (approximately 60 degrees in terms of the rotational angle of the drive gear 66 in the present embodiment) relative to the drive gear 66.

As shown in FIGS. 15 and 16, a plurality of power transmission gears 56 are provided at the roller arm 52 in the extending direction of the roller arm 52 so as to transmit a drive force from the small gear 54 that is provided at the support shaft 51 to the drive gear 66.

The number of power transmission gears 56 is so selected that the tangential line of the sheet feeding roller 60 and the recording sheet agrees with the conveying direction CD of the recording sheet when the support shaft 51 (the small gear 54) is driven to rotate in the direction indicated by the arrow in FIG. 16 to make the distal end of the roller arm 52 swingably move toward the recording sheet (the bottom plate 33).

With this configuration, as a drive force is applied to the sheet feeding roller 60, a conveying force is applied to the recording sheet and the roller arm 52 tends to swing toward the recording sheet due to the reaction force that acts on the sheet feeding roller 60 (drive gear 66). Thus, the sheet feeding roller 60 does not separate from the recording sheet when the drive force is applied to the sheet feeding roller 60, and the conveying force is stably applied from the sheet feeding roller 60 to the recording sheet.

As described above, when pressing the sheet feeding roller 60 against the recording sheet by utilizing the reaction force of the drive force that rotates the sheet feeding roller 60, the pressing force applied by the sheet feeding roller 60 against the recording sheet can easily fluctuate. Particularly, pressure is not produced when the image forming apparatus 1 has just started up and a drive force is not applied to the sheet feeding roller 60.

In view of this problem, as shown in FIG. 3, the image forming apparatus 1 of the present embodiment is equipped with a first torsion coil spring 57 that is provided at the support shaft 51 and the second torsion coil spring 58 that is provided at the distal end of the roller arm 52. The first torsion coil spring 57 constantly produces an urging force for swinging the roller arm 52 toward the recording sheet, regardless of the swinging position of the roller arm 52. The second torsion coil spring 58 produces an urging force for swinging the roller arm 52 toward the recording sheet when the roller arm 52 is positioned in a predetermined swinging range.

As shown in FIGS. 18B, 18C, and 19, when the angle formed by the roller arm 52 and the recording sheet is small and hence the roller arm 52 extends substantially horizontally, the second torsion coil spring 58 contacts a contact piece 4*a* provided at the frame 4 and becomes elastically deformed. As a result, the second torsion coil spring 58 pushes (urges) the roller arm 52 toward the recording sheet. Note that the single-dot chain line in FIGS. 18B and 18C indicates the uppermost recording sheet.

In contrast, as shown in FIG. 18A, when the angle formed by the roller arm 52 and the recording sheet is large, the second torsion coil spring 58 moves away from the contact piece 4*a* so that no urging force is produced to push the roller arm 52 toward the recording sheet. In other words, the second torsion coil spring 58 pushes (urges) the roller arm 52 toward the recording sheet only when the roller arm 52 extends substantially horizontally.

4. Advantages of the Image Forming Apparatus of this Embodiment

Since the bottom plate 33 of the sheet feeding tray 30 is supported by the support ribs 33*a*, when the sheet feeding roller 60 is pushed toward the recording sheet under large pressure, the bottom plate 33 of the sheet feeding tray 30 is prevented from being deflected in the direction of application of the pressure. In other words, the bottom plate 33 of the sheet feeding tray 30 is prevented from being deflected in the direction of application of pressure without increasing the thickness of the bottom plate 33 of the sheet feeding tray 30.

Therefore, according to the present embodiment, a sufficient conveying force can be applied to a recording sheet having a large coefficient of friction such as a sheet of glossy paper or a recording sheet having a large thickness that produces a large conveying resistance and the arm angle can be prevented from becoming excessively large. Thus, the use of a large sheet feeding tray can be avoided and, at the same time, recording sheets that produce a large conveying resistance can be stably fed (conveyed).

Since the support ribs 33*a* are integrally formed on the bottom plate 33 of the sheet feeding tray 30 of the present embodiment, the man-hours for assembling the image forming apparatus 1 can be reduced if compared with an arrangement where the support ribs 33*a* are provided as separate parts. Thus, the use of a large sheet feeding tray can be avoided and, at the same time, recording sheets that produce a large conveying resistance can be stably fed (conveyed), while the manufacturing cost of the image forming apparatus 1 can be suppressed.

Figure 20A:
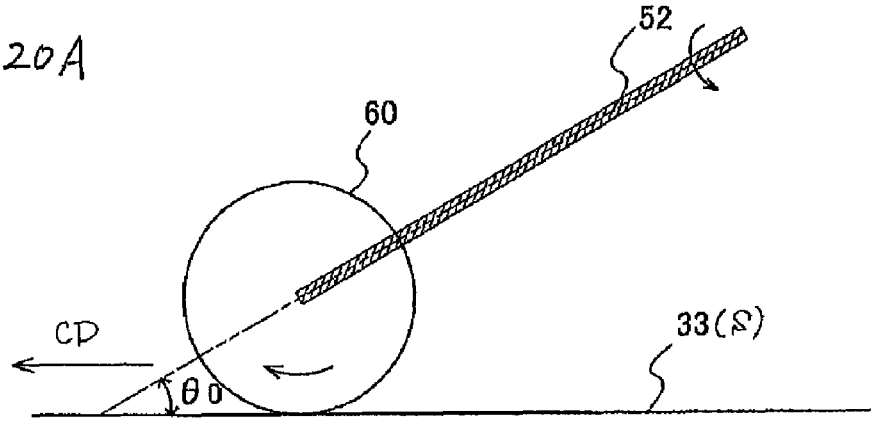
FIG. 20A is an explanatory diagram for illustrating a swinging motion of the roller arm, in which a drive force is not supplied to the sheet feeding roller or conveying resistance acting on the recording sheet is small.
Figure 20B:
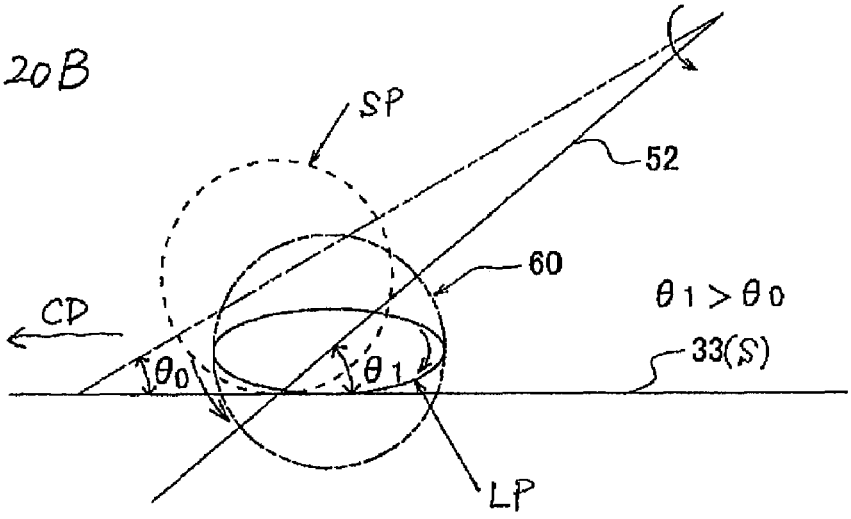
FIG. 20B is an explanatory diagram for illustrating the swinging motion of the roller arm, in which an outer periphery of the sheet feeding roller is greatly deformed due to an increased pressing force.
Figure 20C:
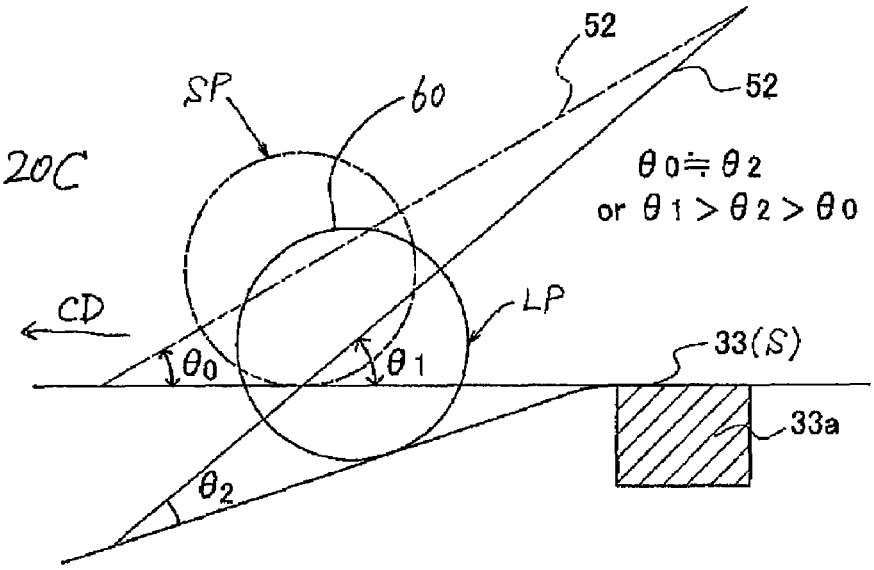
FIG. 20C is an explanatory diagram for illustrating the swinging motion of the roller arm, in which support ribs support a bottom plate of the sheet feeding tray at an upstream side relative to the sheet feeding roller in the conveying direction.

FIGS. 20A through 20C schematically illustrate a swinging motion of the roller arm 52. Note that FIGS. 20A through 20C illustrate deformation of the sheet feeding roller 60 in an exaggerated manner and that the sheet feeding roller 60 is not deformed to such a large extent as shown in FIGS. 20A through 20C in reality.

As shown in FIG. 20A, when a drive force is not supplied to the sheet feeding roller 60 or when conveying resistance acting on the recording sheet S is small and the drive force is also small, an angle formed by the roller arm 52 and the recording sheet S (an arm angle θ) takes an initial value $\theta_0$.

As the conveying resistance increases, the drive force for driving the sheet feeding roller 60 increases correspondingly. Then, the pressure that pushes the roller arm 52 toward the recording sheet S that is the reaction force of the drive force also increases.

The dotted line in FIG. 20B shows an outer periphery of the sheet feeding roller 60 when the pressure that pushes the roller arm 52 toward the recording sheet S is relatively small (small pressure state SP). The solid line in FIG. 20B shows the outer periphery of the sheet feeding roller 60 when the pressure that pushes the roller arm 52 toward the recording sheet S is increased (large pressure state LP). The two-dot chain line in FIG. 20B shows the outer periphery of the sheet feeding roller 60 in a configuration where support ribs are not provided.

In the present embodiment, the deflection of the bottom plate 33 is suppressed by the support ribs 33*a*. Hence, as indicated by the solid line in FIG. 20B, the outer periphery of the sheet feeding roller 60 is greatly deformed due to an increased pressing force and the sheet feeding roller 60 is locked at a position and cannot rotate to convey the recording sheet S, as the sheet feeding roller 60 moves toward the upstream side in the conveying direction CD.

As the sheet feeding roller 60 is locked at a position on the recording sheet S, the roller 60 can no longer feed (convey) the recording sheet S placed on the sheet feeding tray 30. Therefore, it is desirable that the arm angle θ is held to a constant value regardless of the pressure that pushes the roller arm 52 toward the recording sheet S.

However, as described above, the pressure of the sheet feeding roller 60 against the recording sheet S is increased when the roller arm 52 swingably moves toward the recording sheet due to the reaction force for conveying the recording sheet S. Therefore, as shown in FIG. 20B, the swinging angle of the roller arm 52 increases as the pressure increases, and the arm angle θ increases from $\theta_0$ to $\theta_1$.

Thus, as the pressure of the sheet feeding roller 60 is increased in order to convey a recording sheet having a large conveying resistance, the arm angle θ is increased accordingly, and eventually the recording sheet S placed on the sheet feeding tray 30 cannot be fed (conveyed).

In contrast, with the present embodiment, the support ribs 33*a* shown in FIG. 20C support the bottom plate 33 of the sheet feeding tray 30 at the upstream side relative to the sheet feeding roller 60 in the conveying direction CD. Therefore, the bottom plate 33 of the sheet feeding tray 30 is deflected by the pressure applied by the sheet feeding roller 60 slightly more at the downstream side (where no support ribs are provided) than at the upstream side (where the support ribs 33*b* are provided) in the conveying direction CD.

As shown in FIG. 20C, an equation $\theta_0 \approx \theta_2$ ($\theta_0$ is substantially equal to $\theta_2$) or inequality $\theta_1 > \theta_2 > \theta_0$ is satisfied, where an arm angle $\theta_0$ is the arm angle that is formed by the roller arm 52 and the recording sheet S (bottom plate 33) in the small pressure state SP, an arm angle $\theta_1$ is the arm angle that is formed by the roller arm 52 and the original surface of the recording sheet S (bottom plate 33), and an arm angle $\theta_2$ is the arm angle that is formed by the roller arm 52 and the deflected surface of the recording sheet S (bottom plate 33) in the large pressure state LP.

In other words, the bottom plate 33 is lowered more at the downstream side than at the upstream side in the conveying direction CD and the bottom plate 33 is deflected in a direction that makes the bottom plate 33 parallel to the roller arm 52. Thus, even when the pressure is increased and the swinging angle of the roller arm 52 is also increased, the arm angle θ is prevented from increasing excessively.

Thus, in the present embodiment, the arm angle θ can be held substantially to a constant level regardless of the pressure so that the recording sheet S can be stably fed (conveyed) even when the recording sheet has a large conveying resistance.

If the support ribs 33*a* are arranged so as to directly contact an installation surface IS (FIGS. 12 and 14) on which the image forming apparatus 1 is placed, the bottom plate 33 of the sheet feeding tray 30 can be deflected when all the support ribs 33*a* contact the installation surface IS when the installation surface IS is not flat and undulated to form a concaved surface. Then, the bottom plate 33 is likely to be deflected to a large extent.

However, in the present embodiment, the base member 3 is provided with the support plate 3*a* that receives pressure when the support plate 3*a* contacts the support ribs 33*a*. Thus, the bottom plate 33 of the sheet feeding tray 30 is prevented from being deflected to a large extent as the support ribs 33*a* contact the support plate 3*a*.

Thus, when the installation surface IS is not flat but undulated to form a concaved surface, the influence of the undulated surface can be eliminated and the bottom plate 33 of the sheet feeding tray 30 can be prevented from being deflected to a large extent. Then, recording sheets that cause a large conveying resistance can be stably fed (conveyed) regardless of the place where the image forming apparatus 1 is installed.

The image forming apparatus 1 may be configured such that the support ribs 33*a* are constantly in contact with the support plate 3*a*, even when a recording sheet is not being conveyed. Alternatively, the image forming apparatus 1 may be configured such that the support ribs 33*a* are brought into contact with the support plate 3*a* only when the pressure becomes greater than a predetermined level, in other words, the conveying resistance becomes greater than a predetermined level.

Since the support plate 3*a* receives pressure from the sheet feeding roller 60 when the support ribs 33*a* contact the support plate 3*a* in the present embodiment, the support plate 3*a* and hence the bottom plate 33 of the sheet feeding tray 30 can be deflected to a large extent if the flexural rigidity of the support plate 3*a* is small and there is a gap between the support plate 3*a* and the installation surface IS.

In contrast, since the support plate 3*a* of the present embodiment is configured to contact the installation surface IS, the pressure of the sheet feeding roller 60 is received by installation surface IS. Thus, the support plate 3*a* can be prevented from being deflected to a large extent even when the flexural rigidity of the support plate 3*a* is small.

Therefore, the bottom plate 33 of the sheet feeding tray 30 can be prevented from being deflected to a large extent without increasing the thickness of the support plate 3*a*. Then, recording sheets that produce a large conveying resistance can be stably fed (conveyed) without increasing the size of the image forming apparatus.

In the present embodiment, it is configured that the support plate 3*a* having a reference design dimension contacts the installation surface IS. However, since actual products may have dimensional variations, the support plate 3*a* in some products may not contact the installation surface IS. Such dimensional variations do not matter according to the present embodiment because the support plate 3*a* is brought into contact with the installation surface IS when the pressure and the conveying resistance exceed a predetermined level.

In the present embodiment, the support plate 3*a* is provided with the thick part 3*b* that is formed to be thicker than the remaining part of the support plate 3*a* at a position that corresponds to the support ribs 33*a*. Hence, the support plate 3*a* is reliably brought into contact with the installation surface IS at the thick part 3*b*. Thus, the support plate 3*a* can be prevented from being deflected to a large extent even if the flexural rigidity of the support plate 3*a* is small.

Since the sheet feeding tray 30 is detachably accommodated in the base member 3, the bottom plate 33 of the sheet feeding tray 30 can slide on the support plate 3*a* with a large friction when the sheet feeding tray 30 is mounted in the base member 3.

If the upstream side of the support plate 3*a* in the mounting direction MD is made flat without concave portions and protrusions, the support plate 3*a* in the entire area of the leading side slides on the bottom plate 33 of the sheet feeding tray 30 when the sheet feeding tray 30 is mounted in the base member 3, causing large resistance.

However, in the present embodiment, the cutout section 3*g* (having a substantially V-shape that is convex in the mounting direction MD) is formed at the upstream side of the support plate 3*a* in the mounting direction MD. Therefore, the support plate 3*a* in the entire area of the upstream side does not start sliding on the bottom plate 33 of the sheet feeding tray 30 at the same time. In other words, the area in which the support plate 3*a* slides on the bottom plate 33 of the sheet feeding tray 30 gradually increases.

In other words, the contact area (sliding area) gradually increases from left and right side portions of the support plate 3*a* which is less likely to deform toward a center portion which is more likely to deform. Accordingly, even when the support plate 3*a* has some protrusions and concave portions, it is possible to prevent the feeding tray 30 from being blocked by the protrusions. Thus, the resistance produced when the sheet feeding tray 30 is mounted on the base member 3 can be prevented from increasing. Hence, the sheet feeding tray 30 can be mounted with ease.

Additionally, the support plate 3*a* is provided with a tapered section 3*j* that extends along the entire length of the cutout section 3*g* and whose thickness decreases toward the upstream side in the mounting direction MD. Thus, the sheet feeding tray 30 is guided toward the support plate 3*a* with ease when the sheet feeding tray 30 is mounted in the base member 3. Then, the resistance produced when the sheet feeding tray 30 is mounted on the base member 3 can be reduced.

Second Embodiment

An image forming apparatus according to a second embodiment of the invention will be described with reference to FIG. 21, wherein like parts and components are designated by the same reference numerals to avoid duplicating description.

In the above-described first embodiment, the support plate 3*a* directly contacts the installation surface IS, so that the support plate 3*a* is not required to have a large rigidity. In the second embodiment, however, the flexural rigidity of the support plate 3*a* is made greater than the flexural rigidity of the bottom plate 33 of the sheet feeding tray 30.

Figure 21:
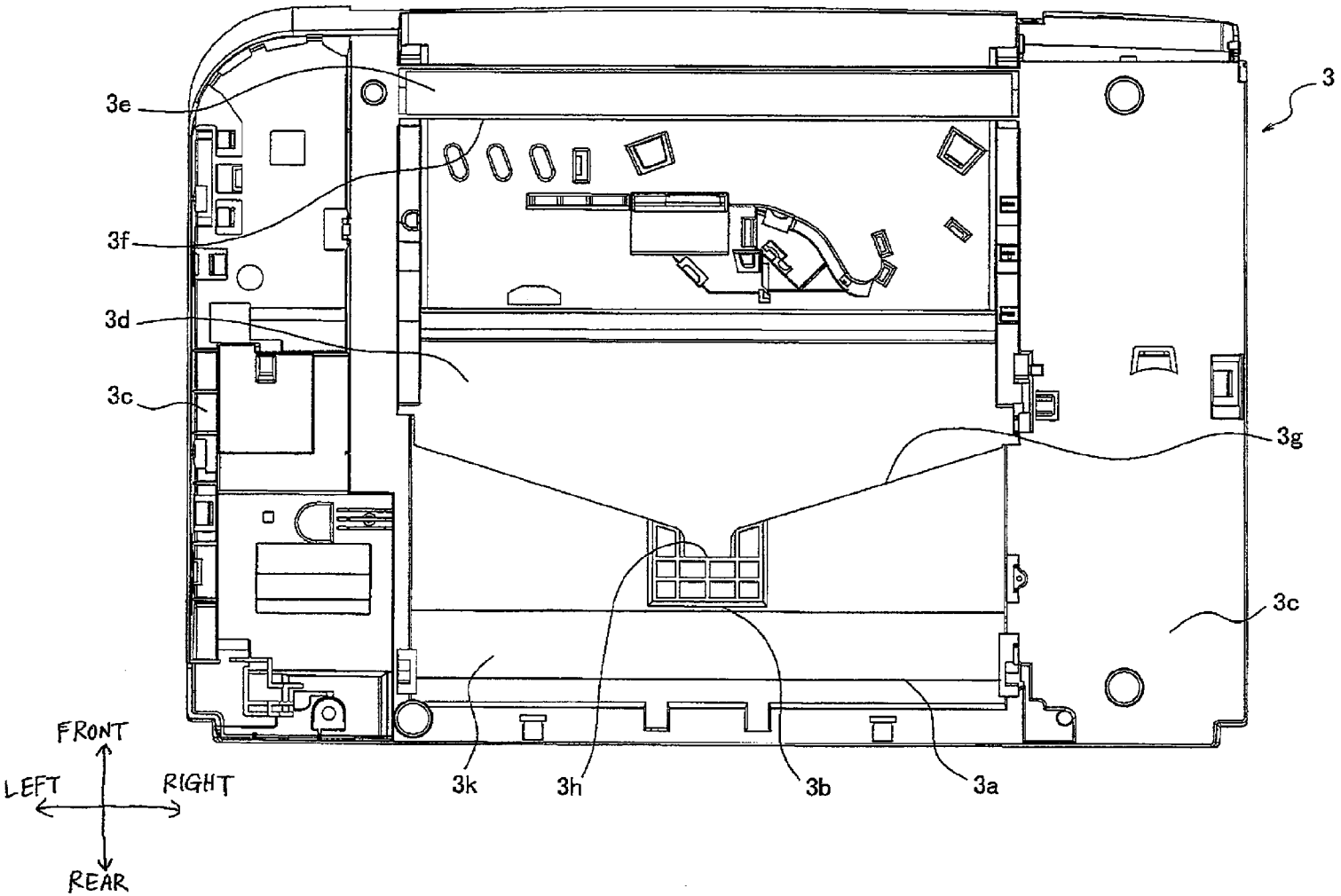
FIG. 21 is a bottom view of a base member according to a second embodiment of the invention.

More specifically, as shown in FIG. 21, a metal plate 3*k* for reinforcement is provided on the bottom surface of the support plate 3*a*, or inside the support plate 3*a*.

With this configuration, the support plate 3*a* of the second embodiment is prevented from being deflected to a large extent. Then, the bottom plate 33 of the sheet feeding tray 30 can be prevented from being deflected to a large extent. Therefore, even when the installation surface IS is not flat but undulated, the bottom plate 33 of the sheet feeding tray 30 can be prevented from being deflected to a large extent by eliminating the influence of the installation surface IS.

In the second embodiment, the flexural rigidity of the support plate 3*a* is made greater than the flexural rigidity of the bottom plate 33 of the sheet feeding tray 30 by providing the metal plate 3*k* for reinforcement at the support plate 3*a*. The invention is not limited to this configuration. For example, the support plate 3*a* itself may be made of metal, or the entire support plate 3*a* may be made as thick as the thick part 3*b*.

While the invention has been described in detail with reference to the above aspects thereof, it would be apparent to those skilled in the art that various changes and modifications may be made therein without departing from the spirit of the invention.

In the above-described embodiments, the support ribs 33*a* are integrally formed with the bottom plate 33 (of the sheet feeding tray 30). The invention is not limited to this configuration. For example, the support ribs 33*a* may be provided at the base member 3, not the sheet feeding tray 30. Alternatively, the support ribs 33*a* may be provided as separate members that are independent from both the sheet feeding tray 30 and the base member 3.

While the support ribs 33*a* can contact the support plate 3*a* in the above-described embodiments, the invention is not limited to this configuration. For example, the support ribs 33*a* may directly contact the installation surface IS.

While the first torsion coil spring 57 and the second torsion coil spring 58 are provided in the above-described embodiments, the invention is not limited to this configuration. For example, one or both of the torsion coil springs 57 and 58 may be omitted.

While an inkjet image forming unit is used as image forming means in the above-described embodiments, the invention is not limited to this configuration, For example, an electrophotographic image forming unit may alternatively be used.

COMPARATIVE EXAMPLE

Figure 22A:
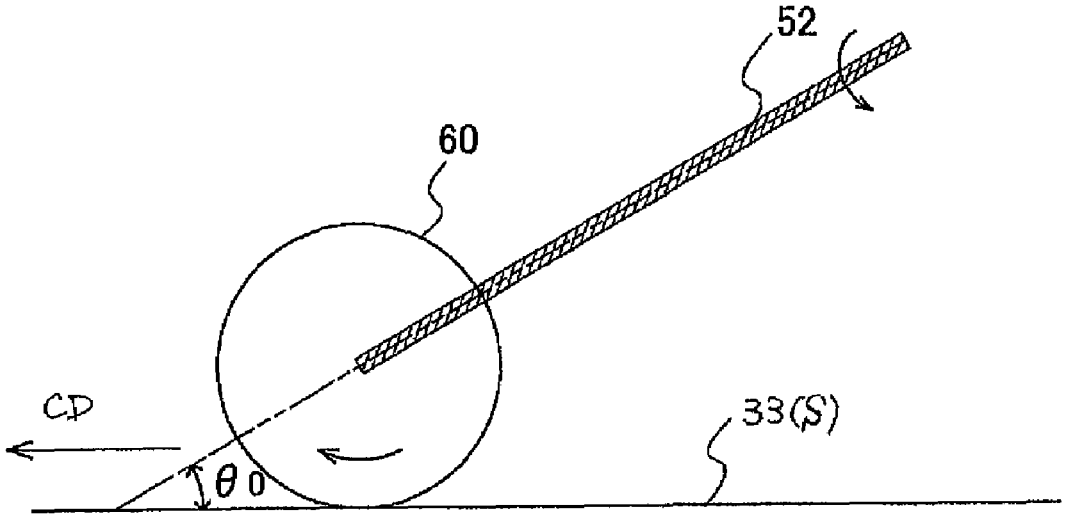
FIG. 22A is an explanatory diagram for illustrating a swinging motion of the roller arm according to a comparative example, in which a drive force is not supplied to the sheet feeding roller or conveying resistance acting on the recording sheet is small.
Figure 22B:
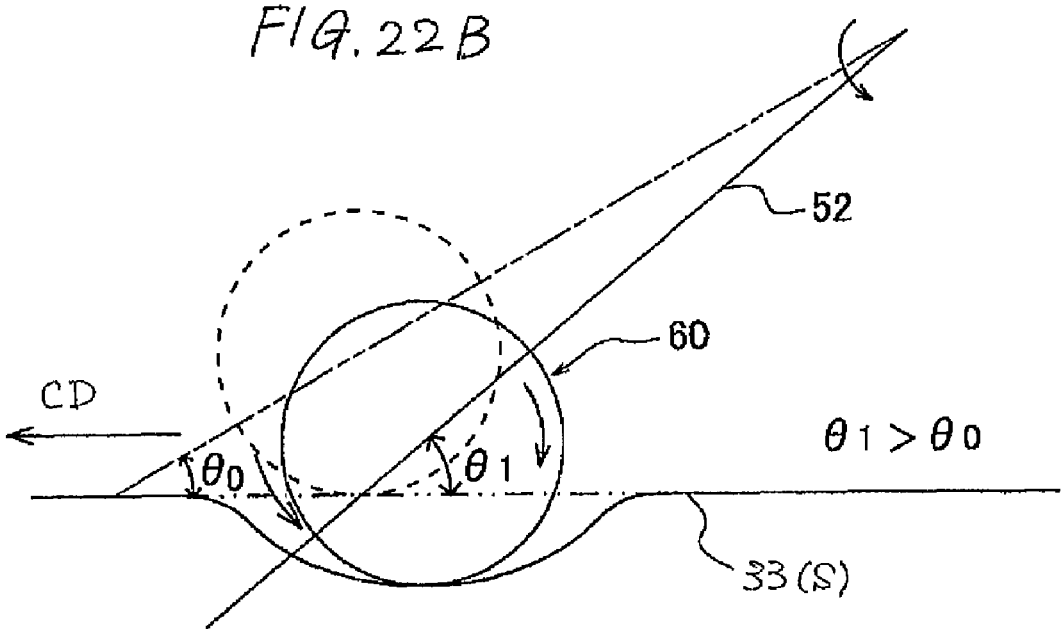
FIG. 22B is an explanatory diagram for illustrating the swinging motion of the roller arm, in which the arm angle is increased and the sheet feeding roller moves toward the upstream side in the conveying direction and depresses the recording sheet.

A comparative example will be described with reference to FIGS. 22A and 22B. FIG. 22A shows a state in which a drive force is not supplied to the sheet feeding roller 60 or conveying resistance acting on the recording sheet S is small. As shown in FIG. 22B, as the arm angle θ is increased, the sheet feeding roller 60 moves toward the upstream side in the conveying direction CD and depresses the recording sheet S. In this state, a conveying force is not applied to the recording sheet S. Then, the recording sheet S placed in the sheet feeding tray 30 cannot be fed (conveyed). However, such problem does not occur in the above-described embodiments because the support ribs 33*a* are provided at the upstream side relative to the sheet feeding roller 60 in the conveying direction CD (FIG. 20C).

What is claimed is:

1. An image forming apparatus comprising:

a base member;

a feeding tray detachably mounted on the base member and including a bottom portion, the bottom portion having a first side that is configured to hold a recording sheet and a second side that is opposite to the first side;

an image forming unit that forms an image on the recording sheet;

a feeding roller that is configured to rotatingly contact the recording sheet held in the feeding tray, thereby feeding the recording sheet toward the image forming unit in a conveying direction;

a roller arm having one end that rotatably supports the feeding roller and another end that is opposite to the one end, the roller arm being configured to swing about the another end, thereby generating a pressing force for pressing the feeding roller against the recording sheet;

a supporting member that is provided at the second side of the bottom portion and that is configured to support the bottom portion against the pressing force; and a base-side supporting member that is provided at the base member and that is configured to contact the supporting member to receive the pressing force, wherein the base-side supporting member is configured to contact an installation surface on which the base member is placed when the image forming apparatus is intended to be used.

2. The image forming apparatus according to claim 1, further comprising a driving transmission mechanism that rotates the feeding roller in the conveying direction and that swingably moves the roller arm toward the recording sheet to generate the pressing force.

3. The image forming apparatus according to claim 1, wherein the supporting member is integrally formed with the bottom portion.

4. The image forming apparatus according to claim 1, wherein the supporting member supports the bottom portion at an upstream position relative to the feeding roller in the conveying direction.

5. The image forming apparatus according to claim 1, wherein the base-side supporting member has a large thickness part at a position corresponding to the supporting member, the large thickness part having a larger thickness than a remaining part of the base-side supporting member.

6. The image forming apparatus according to claim 1, wherein a flexural rigidity of the base-side supporting member is greater than a flexural rigidity of the bottom portion.

7. The image forming apparatus according to claim 1, wherein the supporting member comprises a plurality of ribs each protruding from the second side of the bottom portion and extending in the conveying direction.

8. An image forming apparatus comprising:

a base member;

a feeding tray detachably mounted on the base member and including a bottom portion, the bottom portion having a first side that is configured to hold a recording sheet and a second side that is opposite to the first side;

an image forming unit that forms an image on the recording sheet;

a feeding roller that is configured to rotatingly contact the recording sheet held in the feeding tray, thereby feeding the recording sheet toward the image forming unit in a conveying direction;

a roller arm having one end that rotatably supports the feeding roller and another end that is opposite to the one end, the roller arm being configured to swing about the another end, thereby generating a pressing force for pressing the feeding roller against the recording sheet;

a supporting member that is provided at the second side of the bottom portion and that is configured to support the bottom portion against the pressing force; and a base-side supporting member that is provided at the base member and that is configured to contact the supporting member to receive the pressing force, wherein the base-side supporting member has a plate shape that is substantially parallel to the bottom portion; and wherein the base-side supporting member is formed with a cutout portion at an upstream side thereof in a mounting direction for mounting the feeding tray, the cutout portion having a substantially V-shape that is convex in the mounting direction.

* * * * *